US005874979A

United States Patent [19]

Ohyama

[11] Patent Number: 5,874,979

[45] Date of Patent: Feb. 23, 1999

[54] INK JET RECORDING APPARATUS

[75] Inventor: Kazuo Ohyama, Mitaka, Japan

[73] Assignee: Canon Kabushiki Kaisha, Tokyo, Japan

[21] Appl. No.: 520,741

[22] Filed: Aug. 29, 1995

[30] Foreign Application Priority Data

| | | | |
|---|---|---|---|
| Sep. 2, 1994 | [JP] | Japan | 6-209960 |
| May 26, 1995 | [JP] | Japan | 7-128612 |
| Aug. 3, 1995 | [JP] | Japan | 7-198455 |

[51] Int. Cl.[6] ..... B41J 13/10

[52] U.S. Cl. ..... 347/104; 271/188; 400/642; 400/646; 346/134

[58] Field of Search ..... 347/104; 271/188; 400/642, 646; 346/134

[56] References Cited

U.S. PATENT DOCUMENTS

| | | | |
|---|---|---|---|
| 4,145,967 | 3/1979 | Marozzi . | |
| 4,968,998 | 11/1990 | Allen . | |
| 5,170,183 | 12/1992 | Hirabayashi et al. | 346/134 |
| 5,177,547 | 1/1993 | Kanemitsu et al. | 355/321 |
| 5,393,151 | 2/1995 | Martin et al. | 400/642 |
| 5,409,209 | 4/1995 | Nakamura et al. | 271/271 |

FOREIGN PATENT DOCUMENTS

| | | |
|---|---|---|
| 0 261 764 | 3/1988 | European Pat. Off. . |
| 0 581 531 | 2/1994 | European Pat. Off. . |
| 0 622 227 | 11/1994 | European Pat. Off. . |
| 0 627 322 | 12/1994 | European Pat. Off. . |
| 0 636 486 | 2/1995 | European Pat. Off. . |
| 0 669 212 | 8/1995 | European Pat. Off. . |
| 59-188467 | 10/1984 | Japan . |
| 61-095966 | 5/1986 | Japan . |
| 61-280967 | 12/1986 | Japan . |
| 2-198864 | 8/1990 | Japan . |
| 3029352 | 3/1991 | Japan . |
| 4069264 | 3/1992 | Japan . |
| 6-115068 | 4/1994 | Japan . |
| 7-89069 | 4/1995 | Japan . |
| WO 92/20577 | 11/1992 | WIPO . |

*Primary Examiner*—Benjamin R. Fuller
*Assistant Examiner*—Christina Annick
*Attorney, Agent, or Firm*—Fitzpatrick, Cella, Harper & Scinto

[57] ABSTRACT

An ink jet recording apparatus using an ink jet recording head for recording by discharging ink onto a recording medium arranged in a recording area includes a device for feeding the recording medium. The feeding device is arranged along the recording area and is provided with a mechanism to provide an irregular configuration of the recording medium in the direction intersecting the feeding direction thereof. This minimizes each individual cockling that may take place due to the permeation of ink into the recording medium when images are recorded thereon by the ink jet recording apparatus, and also, orientates the cockling downward reliably in order to prevent the recording medium from being in contact with the recording head to obtain a good quality of recorded images.

15 Claims, 20 Drawing Sheets

INK JET RECORDING APPARATUS

BACKGROUND OF THE INVENTION

1. Field of the Invention

The present invention relates to an ink jet recording apparatus using an ink jet head provided with ink discharge ports to record on a recording medium arranged for a recording area. More particularly, the invention relates to an ink jet recording apparatus capable of significantly reducing adverse effects to be produced on the quality of recorded images, such as cockles on the recording medium resulting from the adhesion of ink droplets thereto.

2. Related Background Art

Traditionally, there has been a need for an ink jet recording apparatus to minimize the influence of wrinkles or a waving deformation (hereinafter referred to as cockling) formed on a recording medium when ink is discharged onto it in order to stabilize the recording performance, and maintain a constant gap between the surface of a recording medium and the recording head. Also, it is required to prevent a recording medium from floating from the platen toward the head in consideration of the fundamental properties thereof that cause it to curl easily if moisture or the like is present.

Conventionally, therefore, as examples to attain the objectives described above, there are apparatuses structured as given below. Firstly, as a recording apparatus disclosed in the specification of Japanese Patent Laid-Open Application No. 4-69264, there is a structure arranged to press a recording medium to the platen by means of a sheet pressure member on the upstream side in the feed direction of the recording medium. Secondly, there is known a structure as disclosed in the specification of Japanese Patent Laid-Open Application No. 61-95966 and Japanese Utility Model Laid-Open Application No. 3-29352, among others, in which a plurality of small-diameter holes are provided for a platen to effectuate the close contact of a recording medium with the platen by the application of suction force generated by use of means for generating negative pressure.

However, in accordance with the first prior art, in which the structure is arranged to press the platen by means of a sheet pressure member on the upstream side of the printing area, the anticipated effects are reduced more so as to give cockling or to allow a recording medium to float more easily if the printing width of a recording head is wider, and the distance is longer from the currently pressed position to the next position to be pressed, although this arrangement is still effective if the printing area is narrower, and also, the distance is shorter from the position where the pressure is given on the upstream side of the printing area in the sheet feeding direction to the next position where pressure is exerted (for example, the sheet exhausting roller pair). Particularly when recording images are formed in high density, a great amount of ink is impacted on the recording medium. As a result, a greater cockling occurs even to allow the recording medium to touch the printing head, thus leading to the formation of disturbed images or the clogging of the heading head.

In accordance with the second prior art, in which an arrangement is made to suck a recording medium by means for generating negative pressure, the apparatus is made inevitably larger, resulting in higher costs, as well as in louder noises made in sucking and exhausting air. Moreover, when recording media of different sizes are used, means for sealing the small-diameter holes should be arranged anew for those holes on the platen, which are not covered by any recording medium, and this sealing arrangement should be made in accordance with each different size of the recording media to be used, hence making it rather difficult to obtain the required suction force as desired.

SUMMARY OF THE INVENTION

It is an object of the present invention to provide an ink jet recording apparatus capable of obtaining a good quality of recorded images by suppressing the cockling (occurrence of cockles on a recording medium along the execution of ink jet recording) and the floating of a recording medium with the arrangement of a simple structure therefor.

It is another object of the present invention to provide an ink jet recording apparatus capable of obtaining a good quality of recorded images by materializing a structure that gives firmness to a recording medium with an arrangement for providing the recording medium with a waving configuration at least in a recording area so as not to allow even a curled recording medium to float in the direction toward the recording head.

It is still another object of the present invention to provide an ink jet recording apparatus capable of obtaining a good quality of recorded images by arranging plural uneven portions on a platen, as well as a member formed at least for the recessed parts thereof to displace a recording medium to the platen side for the formation of a waving configuration thereon in order for the cockling to occur on the recessed parts but assuredly orientated downward, thus preventing the recording medium from floating to the ink jet recording head side.

It is a further object of the present invention to provide an ink jet recording apparatus using ink jet recording means for recording by discharging ink onto a recording medium arranged for a recording area, this apparatus including means for feeding a recording medium being arranged for the recording area and provided with a mechanism to provide irregular configuration for the recording medium in the direction intersecting the feeding direction thereof.

DETAILED DESCRIPTION OF THE PREFERRED EMBODIMENTS

Figure 1:
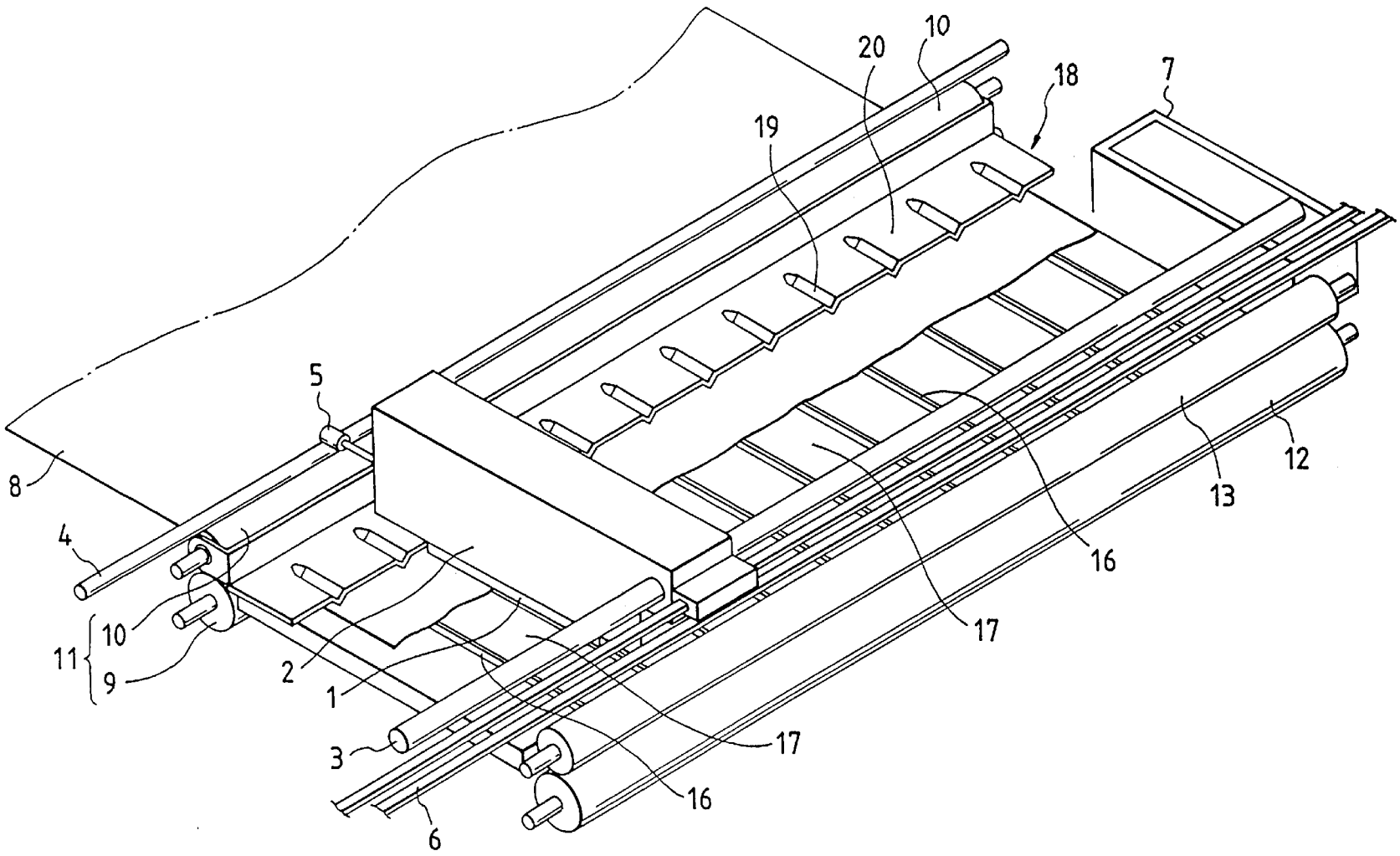
FIG. 1 is a partial view which perspectively shows the vicinity of the platen unit of a recording apparatus in accordance with the first embodiment of the present invention.

Now, with reference to the accompanying drawings, the detailed description will be made of the embodiments in accordance with the present invention.

In this respect, the ink jet recording apparatus to which the present invention is applicable is an ink jet recording apparatus having an ink jet head installed on a head installation unit to discharge ink from the ink discharge ports of the ink jet head onto a recording medium arranged for a recording area. As recording means therefor, it may be possible to use those having a mode in which an ink jet head and an ink tank for supplying ink to this ink jet head are formed integrally and installed on the head installation unit; a mode in which an ink jet head and an ink tank are separate elements, and the ink jet head is provided with an ink tank holder to install the ink tank, and then, installed on the head installation unit; or a mode in which only an ink jet head is installed on the head installation unit while an ink tank is arranged for the recording apparatus main body side. The ink jet heads to be installed on these head installation units include the so-called full line type ink jet head having ink discharge ports arranged over the entire width of a recording medium in the direction intersecting the feed direction of the recording medium arranged for a recording area, and the so-called serial type ink jet head installed on a carriage serving as the head installation unit to reciprocate in the direction intersecting the feed direction of a recording medium arranged for a recording area in order to execute the line recording for one or several lines. Further, the aforesaid recording means may be such as provided with an ink jet head capable of discharging black ink liquid, yellow ink liquid, magenta ink liquid, cyan ink liquid, or several kinds of liquids or all the kinds of liquids among the preprocess liquids. Furthermore, the aforesaid ink jet heads may be such as provided with electrothermal transducing elements on liquid paths conductively connected to the ink discharge ports in order to discharge ink or the like from the ink discharge ports by use of thermal energy generated by the electrothermal transducing elements, or provided with piezoelectric elements arranged on the liquid paths to discharge ink or the like form the ink discharge ports by means of vibrations or volumetric changes of the piezoelectric elements.

The embodiments to which the present invention is preferably applicable are those ink jet recording apparatuses provided with the aforesaid recording means (at least the head installation unit), and a platen to support a recording medium with respect to the head installation unit, which are arranged in the recording area. These apparatuses should be provided with a mechanism capable of supporting the recording medium arranged for the recording area with the provision of plural uneven portions in the direction intersecting the feeding direction of the recording medium, this mechanism being provided with at least a plurality of extrusions arranged in the respective position in the direction intersecting the feeding direction of the recording medium in order to support the back side of the recording surface of the recording medium. Also, it may be possible to arrange further a single or plural numbers of extrusions having a lower height between the aforesaid extrusions themselves of the mechanism: in this respect, it may be possible to arrange different heights for such plural lower extrusions.

Hereunder, the present invention will be described in detail using ink jet recording apparatuses provided at least with the aforesaid platen as those embodying the invention.

(First Embodiment)

FIG. 1 is a perspective view which shows the principal part of the platen unit of an ink jet recording apparatus in accordance with a first embodiment of the present invention.

In FIG. 1, a reference numeral 1 designates an ink jet recording head for recording by discharging ink; 2, a carriage traveling while supporting the recording head 1; 3, a guide rail for supporting and guiding the carriage 2; 4, a supporting rail to support the carriage 2; 5, a guide roller extruded from the carriage 2, which travels on the supporting rail 4 while supporting the carriage; 6, a timing belt tensioned around a pulley (not shown) directly connected to a motor (not shown) to drive the carriage 2; and 7, a cap to protect and prevent the discharge nozzles of the recording head 1 from being dried and stained when the recording head 1 is on standby.

A reference numeral 8 designates a recording medium; 9, a driving roller on the sheet feeding side to carry the recording medium; 10, a resist roller to rotate following the rotation of the driving roller 9 on the sheet feeding side, which is biased to the driving roller 9 on the sheet feeding side by biasing means (not shown), and forms a pair of resist rollers 11 in cooperation with the driving roller 9 on the sheet feeding side.

A reference numeral 12 designates a driving roller on the sheet exhausting side to exhaust the recording medium 8; 13, a sheet exhausting roller to rotate following the rotation of the driving roller 12 on the sheet exhausting side, which is pressed to the driving roller 12 on the sheet exhausting side by biasing means (not shown), thus forming a pair of sheet exhausting rollers 14 in cooperation with the driving roller 12 on the sheet exhausting side. Then the driving roller 9 on the sheet feeding side and the driving roller 12 on the sheet exhausting side are driven by a motor (not shown) through a gear train and others.

A reference numeral 15 designates a platen positioned to face the recording head 1, on which a plurality of ribs 16 are formed in parallel to the feeding direction of the recording sheet. In this respect, it should be good enough if only the ribs 16 are arranged on the platen so that they can provide irregularities on the surface of the recording medium in the direction intersecting the feeding direction of the medium, and they are not positioned in the direction rectangular to the feeding direction of the medium at least with respect to the platen.

A reference numeral 18 designates a sheet pressure board to follow the surface of the recording medium 8 after the configuration of the platen 15, which is arranged in such a manner that the upper surface of ribs 16 of the platen 15 and the leveled portion 20 of the sheet pressure board 18 are in contact with each other. Then extrusions 19 extruding to the platen 15 side are arranged corresponding to the recesses 17 formed between ribs 16 on the platen 15, and biased to the platen 15 side by biasing means (not shown).

In the apparatus structured as described above, the recording head 1 reciprocates on the recording medium 8 by means of a motor (not shown) through the timing belt 6, and records by discharging ink droplets onto specific positions on the recording medium 8.

On the other hand, the recording medium 8 is carried to the nipping position of the resist roller pair 11 by means of the sheet feeding mechanism (not shown). After deviation or the like is corrected, the recording medium 8 is further carried to the recording position by the rotation of the resist roller pair 11 driven by a motor (not shown) through a gear train and others (not shown). At this juncture, the sheet pressure board 18 is biased in the direction toward the platen 15 to make the recording medium wavy, its vertices being formed at the ribbed portions 16 on the platen 15 by means of the extrusions 19 of the sheet pressure board 18 and the ribs 16 of the platen 15, and the troughs at the extruded portions 19 of the sheet pressure board 18.

Now, with reference to FIG. 2 and FIG. 3, the description will be made of the states of a recording medium 8 before and after recording.

Figure 2:
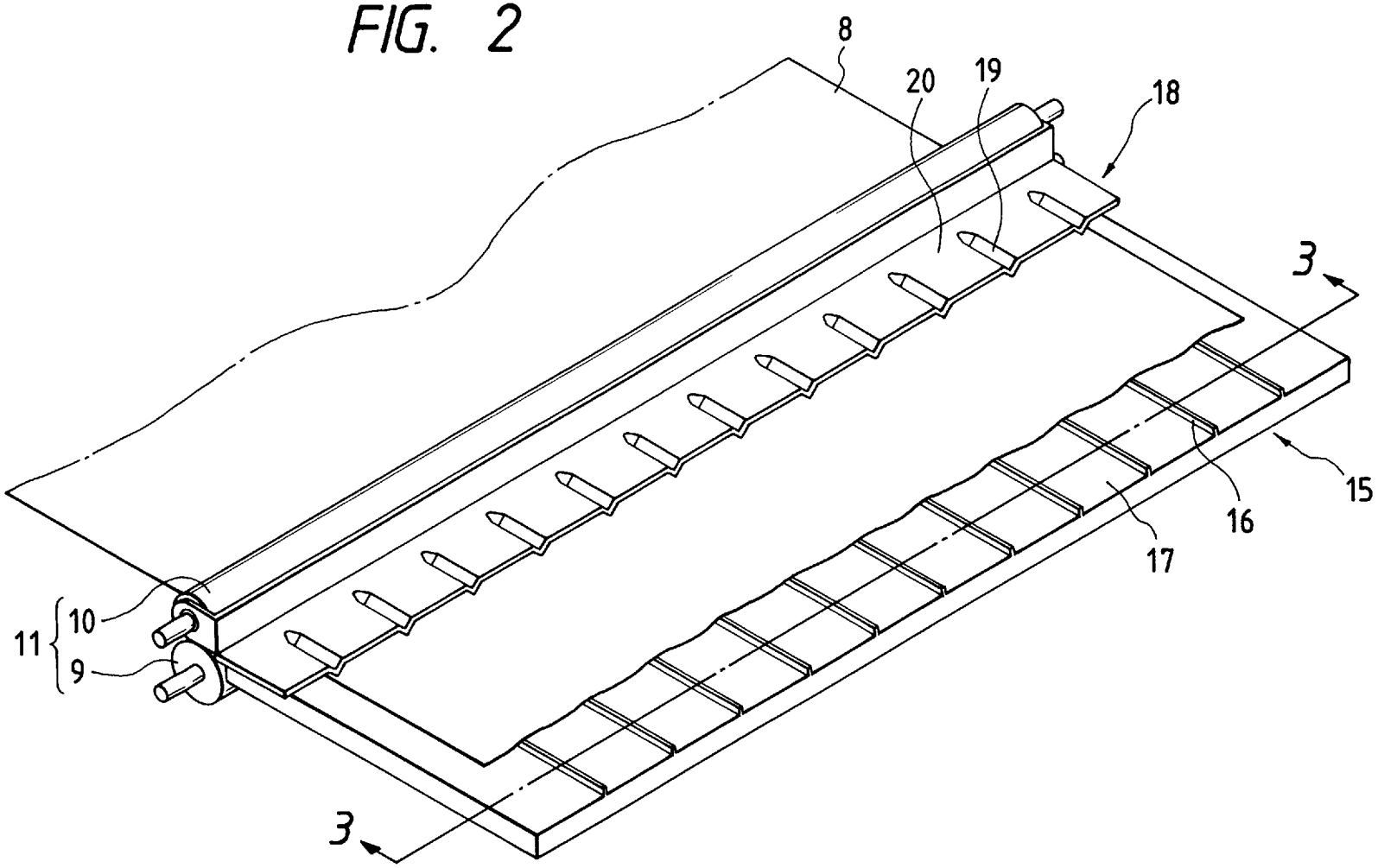
FIG. 2 is a perspective view which illustrates a state where a recording medium passes between a platen and a sheet pressure board.

FIG. 2 is a perspective view which shows the simplified representation of the part illustrated in FIG. 1. FIG. 3 is an enlarged section taken along line 3—3 in FIG. 2.

Figure 3:
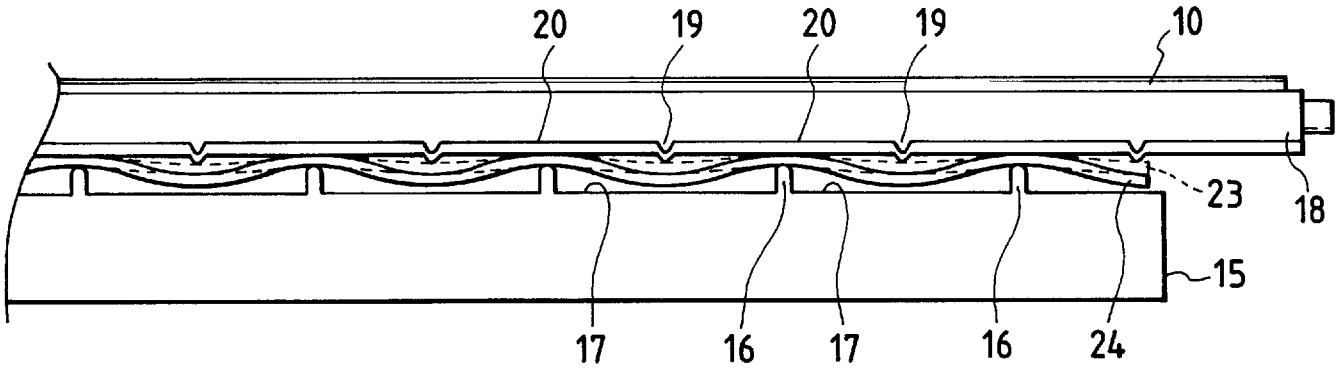
FIG. 3 is a cross-sectional view taken along line 3—3 in FIG. 2.

In the recording operation described above, the recording medium 8 having passed the sheet pressure board 18 presents a slightly undulated form as indicated by a broken line in FIG. 3, whose vertices are at the ribbed portions 16 on the platen 15, and troughs at the extruded portion 19 of the sheet pressure board 18. In this case, if recorded images are made in high density, the recording medium 23 is in a state that a great amount of recording ink is impacted using mainly water as its solvent, hence causing the recording medium to become larger in its dimensions due to swelling. Here, the recording medium 23 is fixedly positioned immediately before the recording area at a plurality of contacting points of the ribs 16 of the platen 15 (vertices of the undulated recording medium 23) and the sheet pressure board 18. As a result, while it can hardly move even when swelling occurs, no movement is regulated in the gaps 17 between the plurality of ribs. Therefore, due to such swelling, the recording medium 23 is caused to expand mainly in the gaps 17 between the ribs.

Further, in this respect, the recording medium is pressed downward in advance by means of the extrusions 19. Consequently, the waving (cockling) is orientated downward without exception, hence enabling it to be in a state represented by a recording medium 24 after recording has been made in high density. Also, the swelling of the sheet occurs as the cockling that has been distributed evenly in the gaps 17 between the plurality of ribs. Therefore, it is possible to suppress and make each individual cockling small, and there is no possibility that the sheet floats toward the recording head 1 side.

Also, there is a problem that a recording medium is subjected to curling due to atmospheric environment. This problem is related particularly to the abrupt changes of humidity in the atmospheric environment. In a high humid environment, this problem often occurs because the recording medium absorbs moisture and swells. In a case of low humidity, too, the moisture contained in the recording medium is released externally, resulting in the contraction of the recording medium, thus causing it to be curled. In the present embodiment, however, the wavy configuration is provided for the recording medium, thus giving firmness to it to mitigate the influence of curling that may be exerted on the recording medium. As a result, there is also no possibility that the recording medium floats toward the recording head 1 side.

(Second Embodiment)

Figure 4:
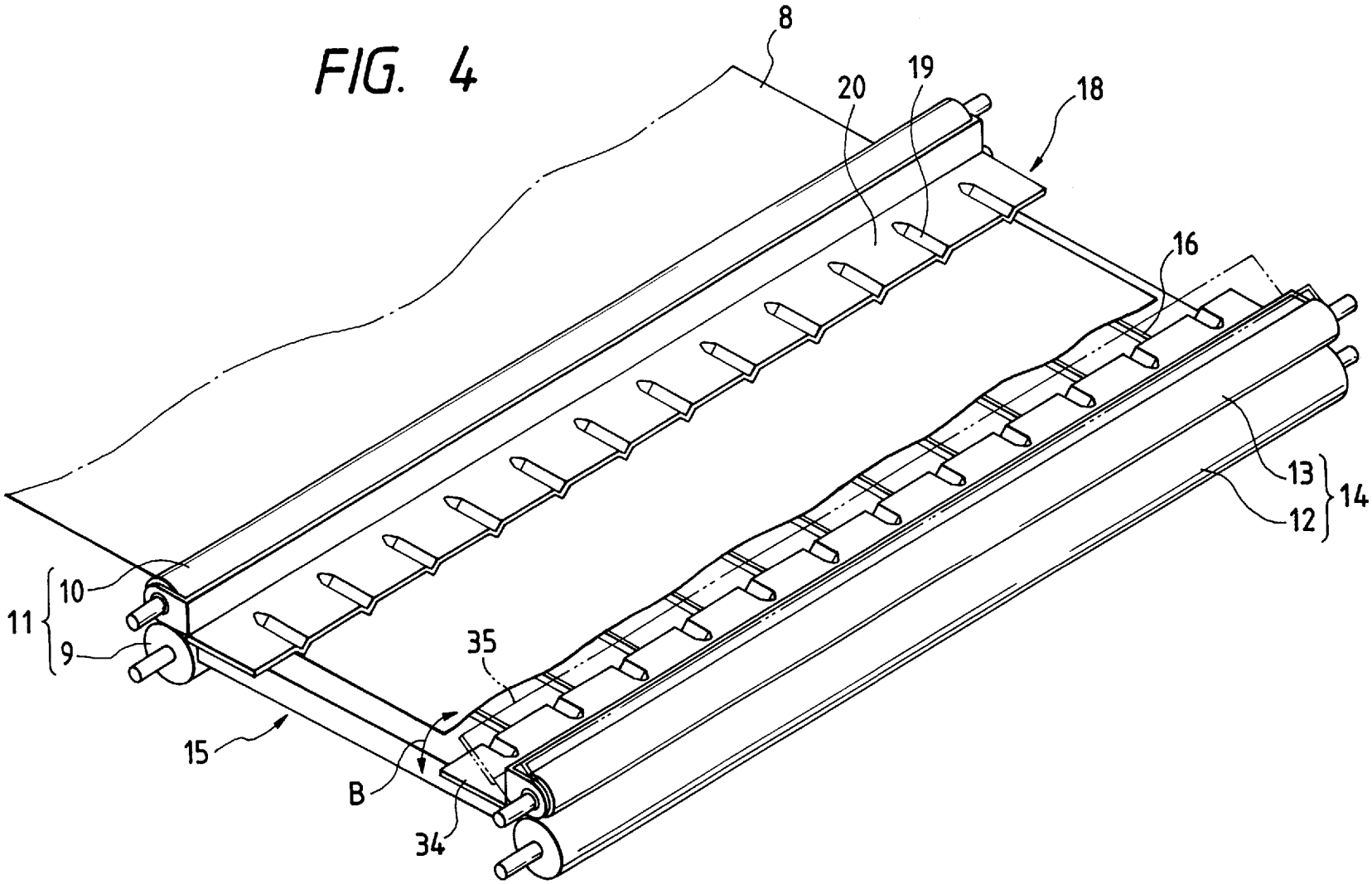
FIG. 4 is a perspective view which illustrates a state where a recording medium passes between the platen and sheet pressure board of a recording apparatus in accordance with a second embodiment of the present invention.

FIG. 4 is a perspective view which shows the principal part of a second embodiment in accordance with the present invention. Here, the same reference numerals are applied to the same or equivalent members appearing in the first embodiment described above. Any repeated description will be omitted.

In the first embodiment, a sheet pressure board 18 is arranged on the upstream side of the recording area, but in the second embodiment, a sheet pressure board 34 is likewise arranged on the downstream side of the recording area as shown in FIG. 4.

The sheet pressure board 34 is made rotative around a sheet exhausting roller 13 by rotary means (not shown) in the direction indicated by arrow B. When the recording medium 8 is carried, this board is in a state at 35 indicated by two-dot chain line. It is retracted so as not to hinder the carriage of the recording medium. At any other time, the board remains in a state at 34 indicated by solid line so as to give the waving configuration to the recording medium 8.

In this way, it is possible to produce the waving configuration both on the upstream and downstream sides of the recording area, thus obtaining the anticipated effects more reliably. Also, even after the trailing end of the recording medium 8 passes the sheet pressure board 18 in the recording area, it is possible to continuously provide the waving configuration for the recording medium.

(Third Embodiment)

Figure 5:
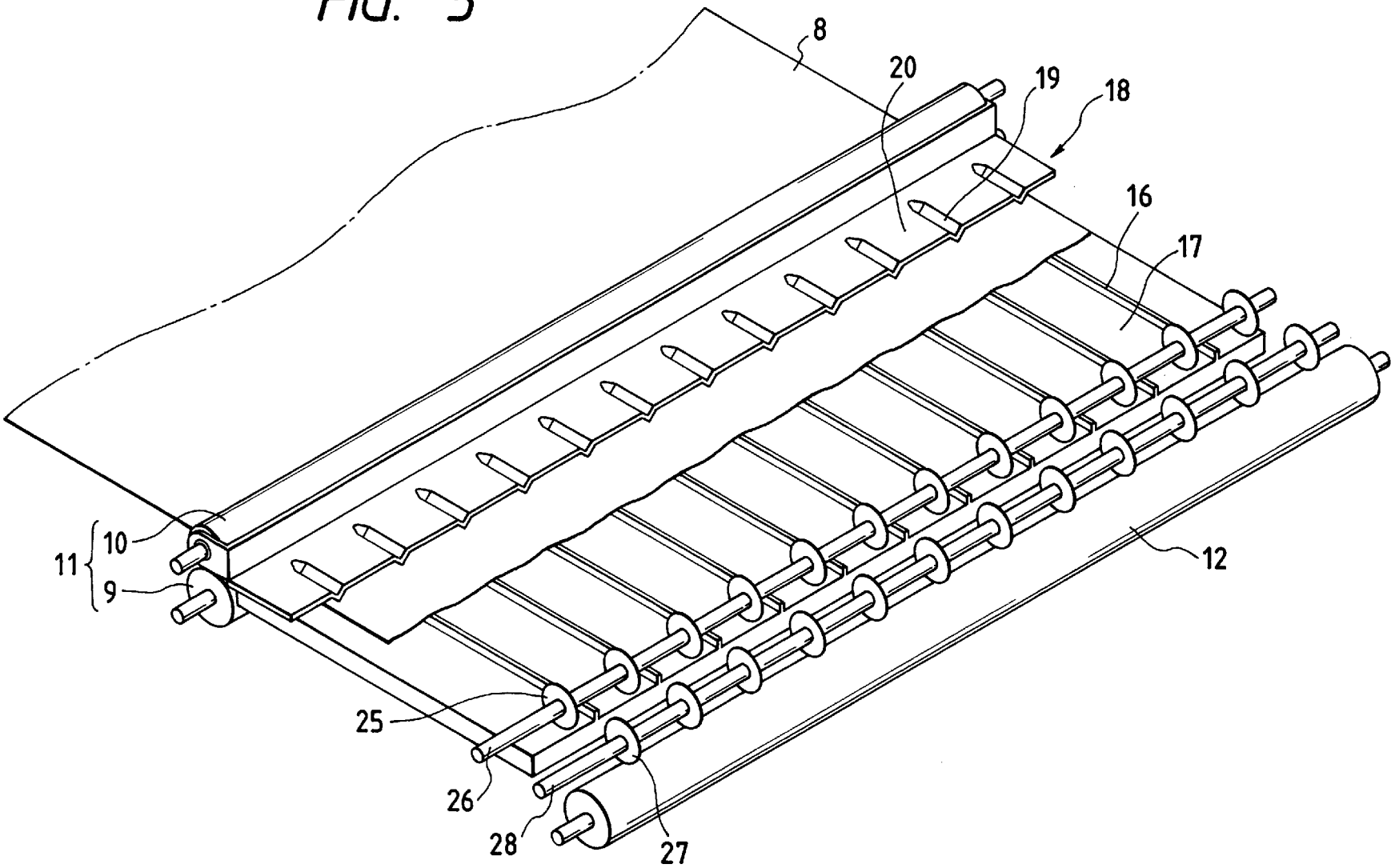
FIG. 5 is a perspective view which illustrates a state where a recording medium passes between the platen and sheet pressure board of a recording apparatus in accordance with a third embodiment of the present invention.

FIG. 5 is a perspective view which shows the principal part of a third embodiment in accordance with the present invention. Here, the same reference numerals are applied to the same or equivalent members appearing in the first embodiment described above. Any repeated description will be omitted.

In FIG. 5, a reference numeral 25 designates spurs arranged in the positions facing the extrusions 19 of the sheet pressure board 18 to allow them to enter the gaps 17 between the ribs on the platen 15 to the same extent as the extrusions 19, and 26, a rotational shaft to support the spurs 25, which is driven by means of a motor (not shown), and rotate the spurs 25 at the same circumferential speed as the feeding speed of the recording medium 8 so that the spurs 25 do not resist the feeding of the recording medium 8 when the spurs 25 are pressed to it.

A reference numeral 27 designates spurs for use of sheet exhaust, which rotate following the rotation of a driving roller 12 arranged on the sheet exhausting side: these spurs are biased in the direction toward the sheet exhaust driving roller 12 by use of biasing means (not shown); and 28, a shaft serving as the rotational center of the sheet exhaust spurs.

With the structure described above, the spurs 25 serve the same purpose as that of the extrusions 19 of the sheet pressure board 18. Therefore, it is possible to provide the waving configuration on the upstream side as well as on the downstream side of the recording area, and to prevent the recording medium 8 from floating toward the recording head 1 side reliably. Also, even after the trailing end of the recording medium 8 passes the sheet pressure board 18, it is possible to provide the waving configuration continuously.

Figure 6:
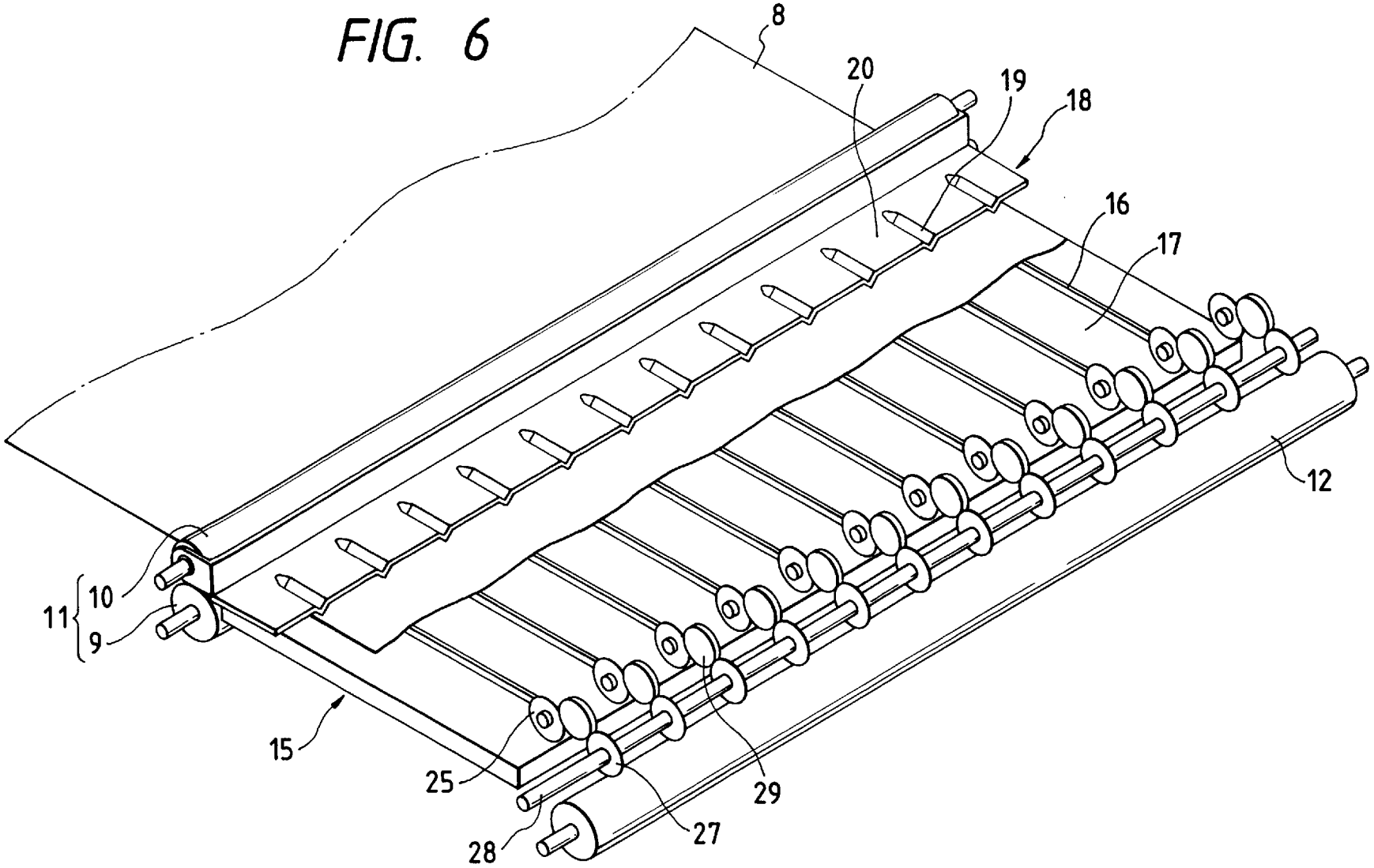
FIG. 6 is a perspective view which illustrates a state where a recording medium passes between the platen and sheet pressure board of a recording apparatus in accordance with a third embodiment of the present invention.

FIG. 6 is a perspective view of the structure in which cleaners 29 are additionally arranged for the structure described above in order to remove recording ink adhering to the spurs 25 and the sheet exhausting spurs 27.

As shown in FIG. 6, the spur cleaners 29 are evenly pressed both by the sheet exhaust spurs 27 and the pressure spurs 25.

In the structure described above, the spur cleaners 29 rotate following the rotation of the sheet exhaust spurs 27, and cause the spurs 25 to rotate following the rotation of these cleaners. As a result, it is possible to make the circumferential speed of the spurs 25 substantially equal to that of the sheet exhausting roller 12.

In the present embodiment, while the structure has been described such as to press the recording medium 8 by means of the spurs 25, the present invention is not necessarily limited to the provision of such spurs if only a structure is formed to satisfy the function and performance as described above, although the spurs are extremely effective, because unsettled recording ink is not easily transferred to them even when the fixation of recorded ink is slow after it has been discharged onto a recording medium. Also, the amount of ingression of the spurs 25 into the gaps 17 between ribs on the platen 15 is described to be made to the same extent as the extrusions 19 of the sheet pressure board 18, but a different amount of such ingression may be adopted in this respect.

(Fourth Embodiment)

The present embodiment is such that the spurs 25 of the third embodiment described above are arranged on the sheet exhausting roller.

Figure 7:
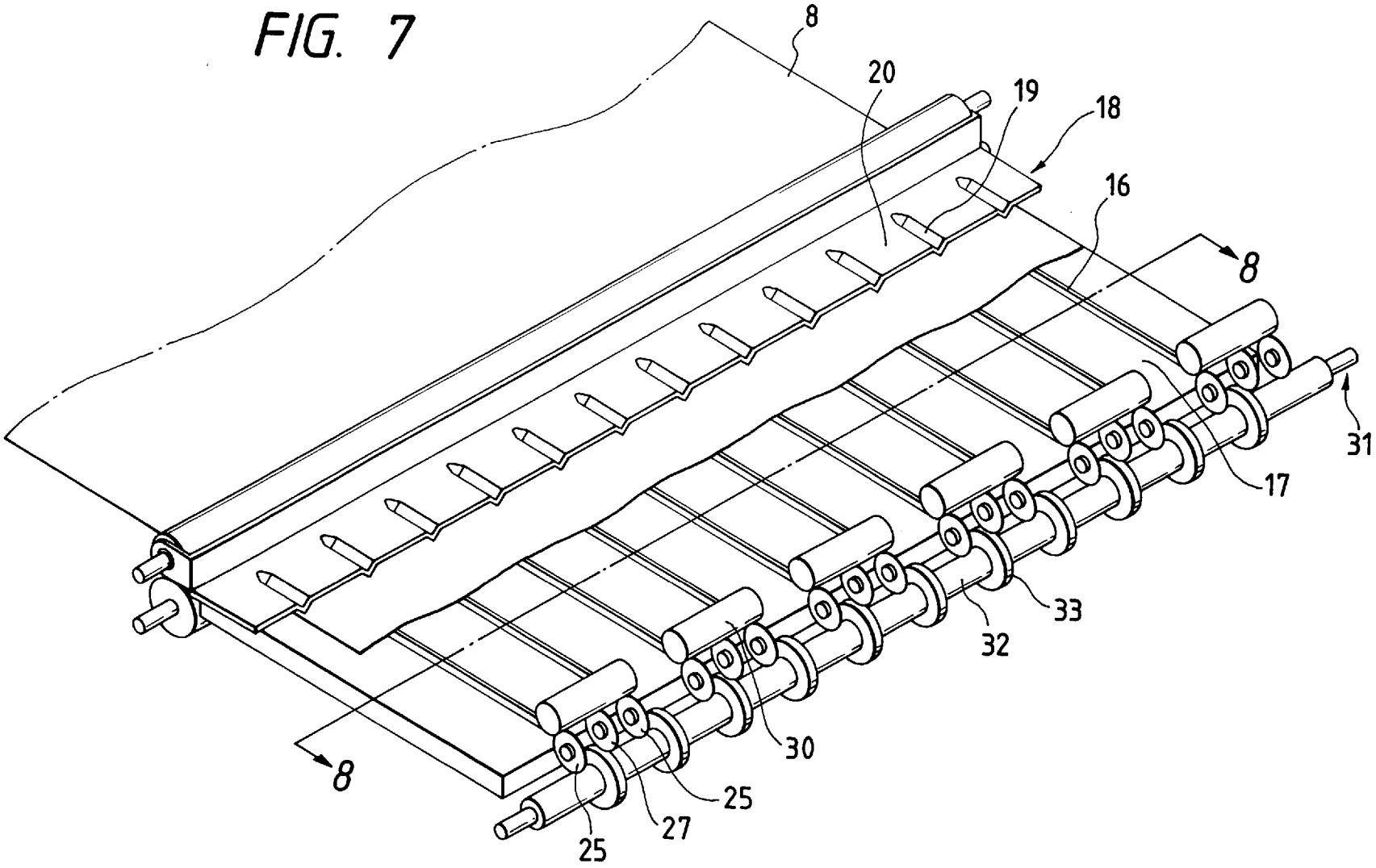
FIG. 7 is a perspective view which illustrates a state where a recording medium passes between the platen and sheet pressure board of a recording apparatus in accordance with a fourth embodiment of the present invention.
Figure 8:
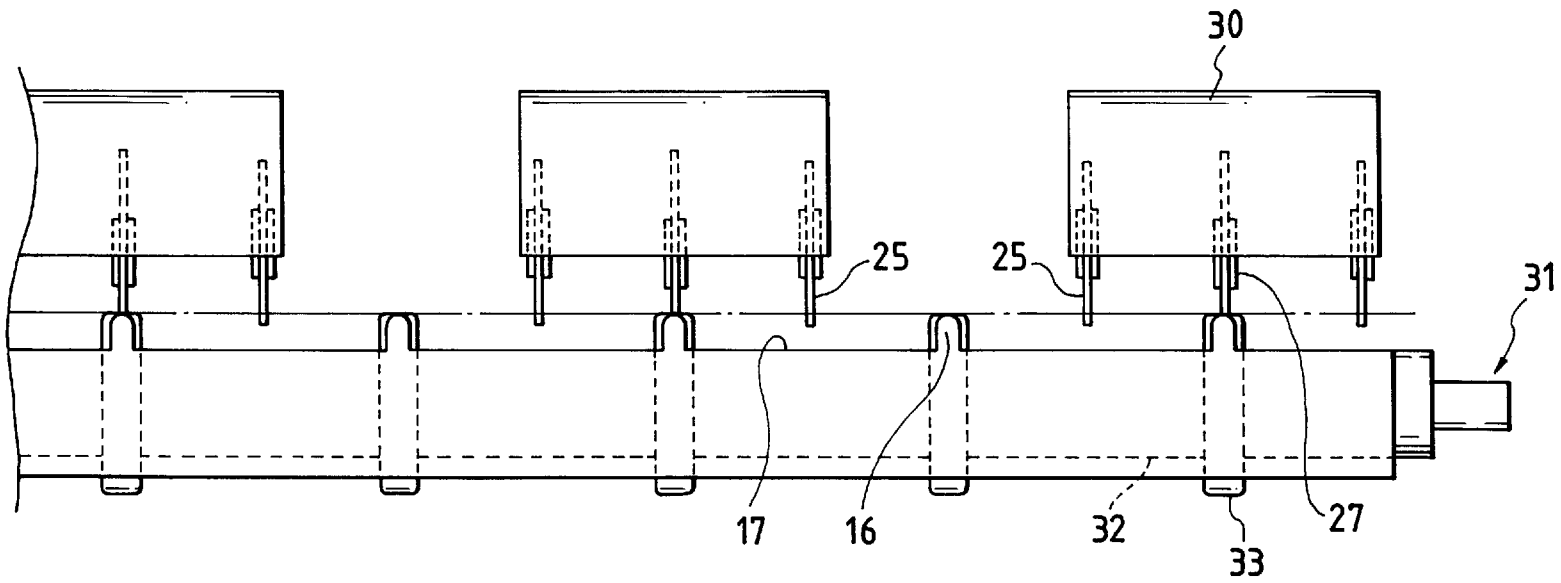
FIG. 8 is a cross-sectional view taken along line 8—8 in FIG. 7.

FIG. 7 is a perspective view which shows the principal part of a fourth embodiment in accordance with the present invention. FIG. 8 is an enlarged section taken along line 8—8 in FIG. 7. In this respect, the same reference numerals are applied to the same or equivalent members of the third embodiment represented in FIG. 5. Any repeated description thereof will be omitted.

In FIG. 7 and FIG. 8, a reference numeral 31 designates a strip type sheet exhausting roller, which is provided with recesses 32 and extrusions 33, and driven by means of a motor (not shown) through a gear train and others. The recesses 32 are arranged on the extended lines of the gaps 17 between ribs on the platen 15, while the extrusions 33 are formed on the extended lines of the ribs 16, and arranged to be of the same height of the ribs 16.

The spurs 25 are arranged on the recesses 32, respectively, in the same position and same ingression amount as the extrusions 19 of the sheet pressure board 18, and rotatively supported and fixed in each position by holders (not shown). The sheet exhaust spurs 27 are rotatively supported by holders (not shown) to rotate following the rotation of the sheet exhausting roller when these spurs are pressed to the extrusions 33 thereof.

The spur cleaners 30 are the members to remove recording ink adhering to the spurs 25 and sheet exhaust spurs 27, and in the present embodiment, each of them rotates following the rotation of each one of sheet exhaust spurs 27 and causes each two spurs 25 to rotate following the rotation of each one of the spur cleaners.

In the structure described above, the recesses 32 of the strip type sheet exhausting roller 31, and the spurs 25 play the same roles of the gaps 17 between the ribs 17 on the platen 15, and the extrusions 19 of the sheet pressure board 18. The extrusions 33 play the same role as the ribs 16 of the platen 15. Therefore, it is possible to provide the waving configuration reliably until the recording medium 8 has been exhausted, hence preventing the recording medium 8 from floating more reliably.

Also, the spurs 25 and the sheet exhaust spurs 27 are arranged on the same lines. Consequently, each sheet exhausting roller is arrangeable in a position on the upstream side of the sheet feeding direction, thus making it possible to nip the recording medium earlier. As a result, its feeding in the direction toward the downstream side becomes more reliable.

In the first to fourth embodiments described above, if the distance is short between the resist roller pair 11 and the extrusions 19 of the sheet pressure board 18, the waving of the recording medium 8 may be hindered by the nipping of the resist roller pair 11. Therefore, it may be possible to arrange a recessed portion on each part of the driving roller 9 on the sheet supply side in agreement with each trough of the waving configuration.

Also, the left and right edges of a recording medium tend to float easily toward the recording head 1 side due to the warping or the like. Therefore, it is preferable to arrange the extrusions 19 of the sheet pressure board 18 and the extruded members on the downstream side in the sheet feeding direction to be in agreement with these edges of the recording medium so that the edges thereof are pressed downwardly as shown in FIG. 3.

If there are several kinds of sizes for recording media to be used, it should be arranged to make the positions adjustable for the extrusions 19 of the sheet pressure board 18 and the extruded members on the downstream side so that each of the edges of the recording media is reliably orientated downward.

(Fifth Embodiment)

Figure 9:
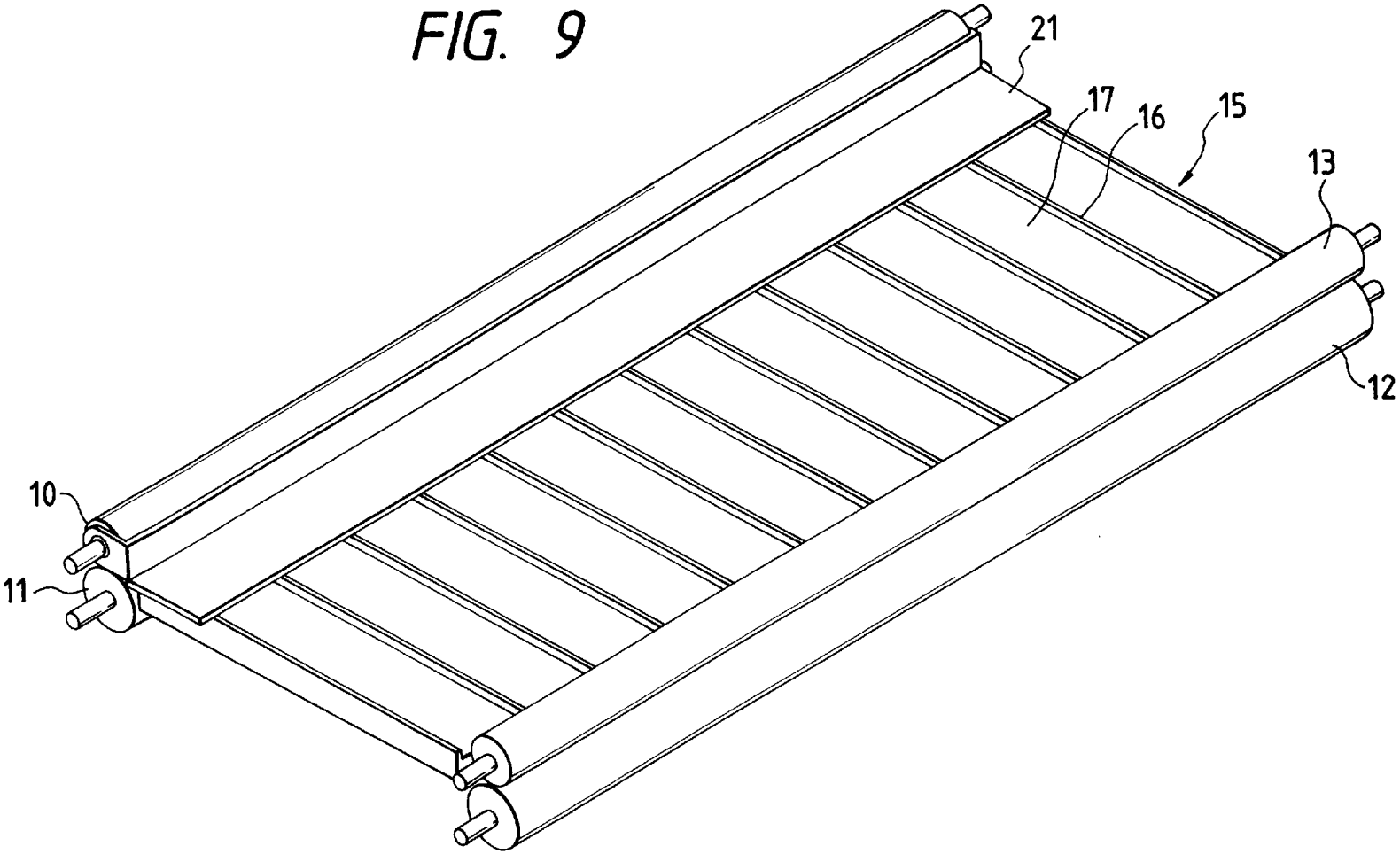
FIG. 9 is a partial view which perspectively shows the vicinity of the platen unit of a recording apparatus in accordance with the fifth embodiment of the present invention.

FIG. 9 is a perspective view which shows the principal part of a fifth embodiment in accordance with the present invention. Here, in the present embodiment, the same reference numerals are applied to the same or equivalent members appearing in the embodiments described above. Any repeated description thereof will be omitted.

In the present embodiment, the structure is arranged to enable a flat sheet pressure board 21 to be biased to the platen 15 side by biasing means (not shown) in order to enable it to abut upon the ribs 16 of the platen 15. This embodiment is limited to the use of an apparatus for recording on vertically watermarked paper.

When the vertically watermarked paper absorbs water, it tends to swell by its nature in the direction rectangular to the sheet feeding direction. Therefore, by fixing the position of the vertically watermarked paper, it is possible to create cockling in each gap 17 between ribs in the plural positions where the ribs 16 and the flat sheet pressure board 21 are in contact with each other. Further, since the upper part of each gap 17 between the ribs is also regulated by means of the flat sheet pressure board, the cockling is reliably orientated downward, and there is no possibility that the recording medium floats toward the recording head 1 side.

(Sixth Embodiment)

Figure 10:
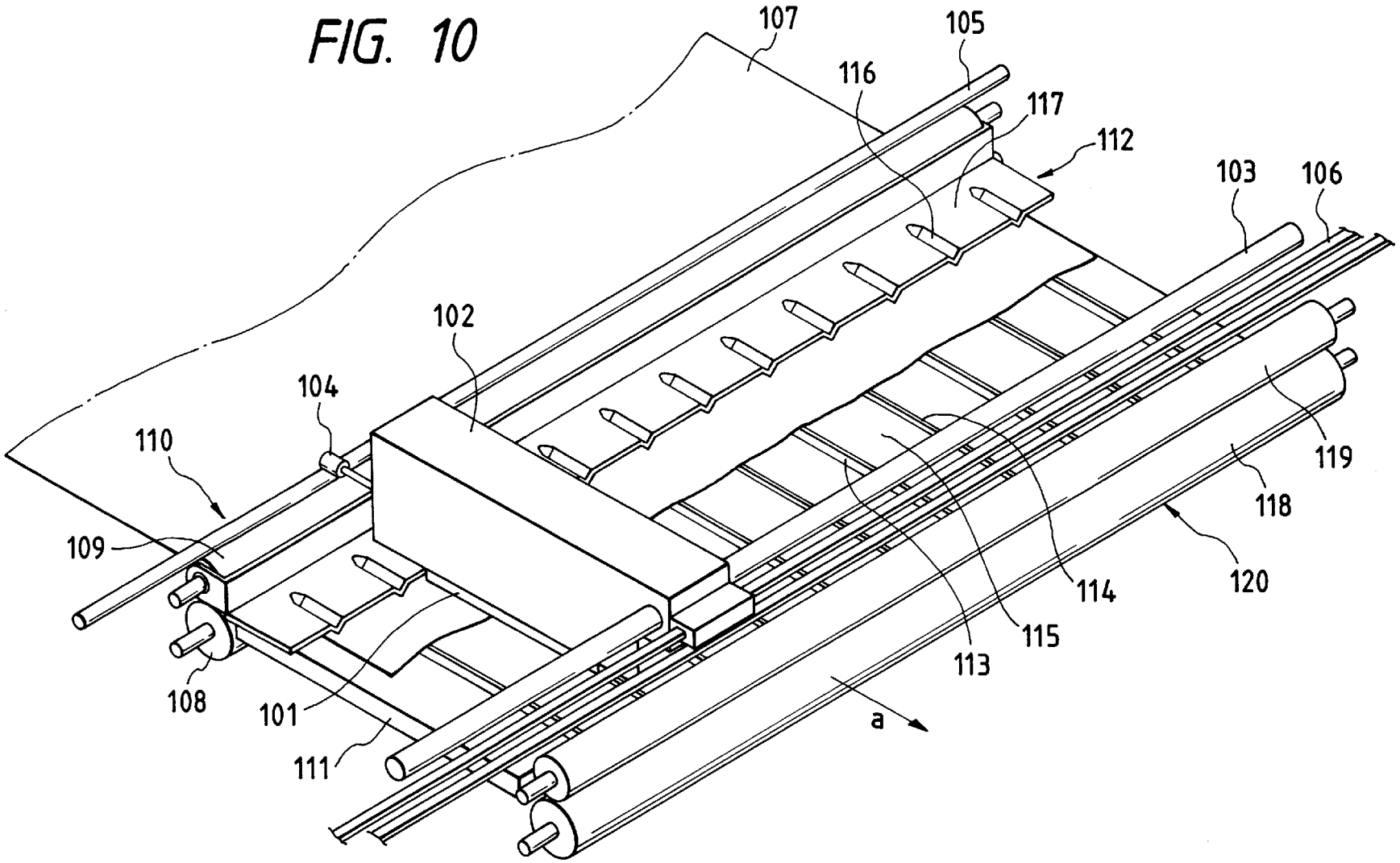
FIG. 10 is a partial view which perspectively shows the vicinity of the platen unit of a recording apparatus in accordance with the sixth embodiment of the present invention.

FIG. 10 is a partial view which perspectively shows the vicinity of the platen of a recording apparatus in accordance with a sixth embodiment of the present invention.

In FIG. 10, an ink jet head 101 is mounted on a carriage 102. The carriage 102 is supported by a guide rail 103, and a guide roller 104 extruded from the carriage 102, which is in contact with a supporting rail 105. The carriage scans on the guide rail 103 and the supporting rail 105 when driven by a carriage motor (not shown) through a timing belt 106.

On the other hand, a recording medium 107 is carried by a sheet supply mechanism (not shown) to the nipping position (pinching position) of a resist roller pair 110 formed by a driving roller 108 on the sheet supply side to carry the recording medium 107, and a resist roller 109 to rotate following the rotation of the driving roller 108 on the sheet supply side when it is pressed to the driving roller by means for pressing it (not shown), and then, the deviation or the like is corrected. After that, by the rotation of the resist roller pair 110 driven by means of a motor (not shown), the recording medium is carried to the recording position through the passage between the platen 111 positioned to face the recording head 101 and the sheet pressure board 112. Here, a plurality of ribs 113 and auxiliary ribs 114 whose height is shorter than the ribs 113 are arranged on the platen 111 in parallel to the sheet feeding direction. In this respect, it should be good enough if only the ribs 16 are arranged on the platen to provide irregularity on the surface of the recording medium in the direction intersecting the sheet feeding direction, and at least such arrangement is not made in the direction rectangular to the sheet feeding direction. Also, extrusions 116 are arranged on the sheet pressure board 112, each extruding to the respective recessed portion 115 of the platen on each gap between the rib 113 and auxiliary rib 114 on the platen 111. Then the horizontal portion of the sheet pressure board 112 is biased to the ribs 113 by biasing means (not shown) so that it abuts upon them.

Figure 11:
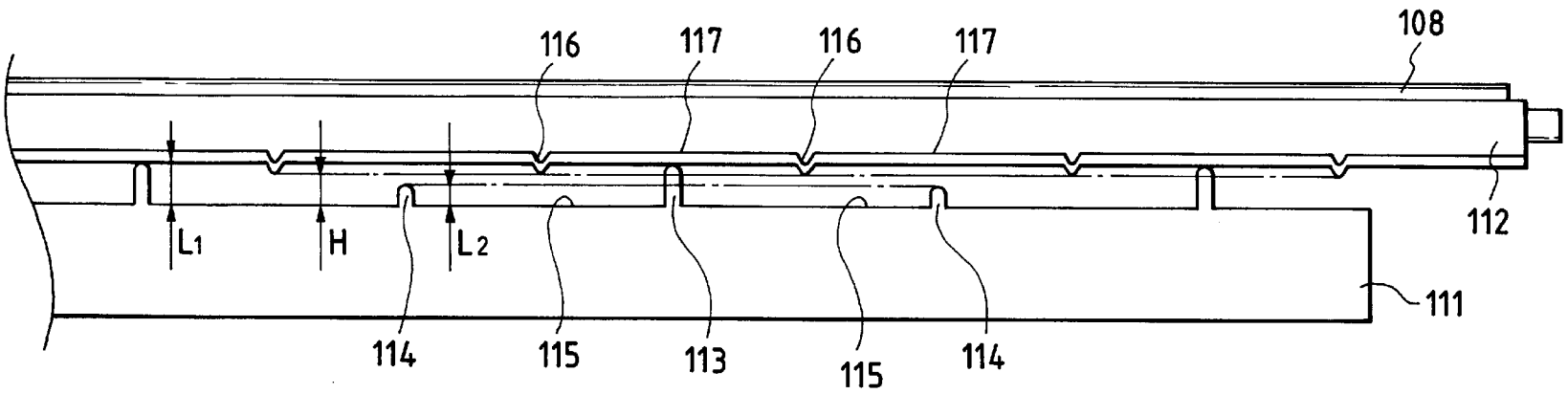
FIG. 11 is a partial front view which shows the relationship between the platen and sheet pressure board of the sixth embodiment of the present invention.

However, the mutual relations between the heights from the recessed portions 115 of the platen to the respective vertices of the rib 113, auxiliary rib 114, and extrusion 116 are:

$$L_2<H<L_1$$

where each of the heights is $L_1$, $L_2$, and H, respectively as shown in FIG. 11. Therefore, when the recording medium 107 is in contact with each rib 113 and the extrusion 116, it presents a continuous waving configuration having its vertex at each rib portion 113 and through between two ribs 113 in a section rectangular to the sheet feeding direction.

Now, for the recording medium 107 carried to the recording position, recording is executed by ejecting ink droplets on the specific positions by causing the recording head 101 to scan. Then the recording medium is exhausted in the direction indicated by arrow a by means of sheet exhaust roller pair 120 formed by a driving roller 118 on the sheet exhausting side, which is driven by a motor (not shown), and a sheet exhausting roller 119 to rotate following the rotation of the driving roller 118 on the sheet exhausting side when it is biased to this driving roller by biasing means (not shown). The medium thus exhausted is stored in an exhaust sheet tray (not shown).

Figure 13:
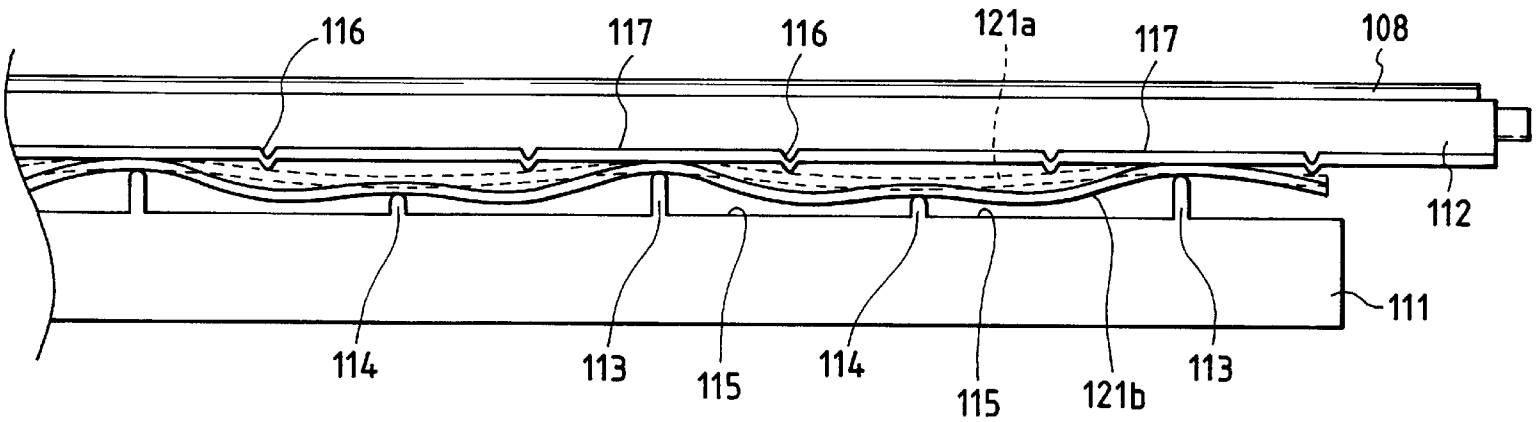
FIG. 13 is a cross-sectional view taken along line A—A in FIG. 12, which shows the behavior of a vertically watermarked paper before and after recording.
Figure 12:
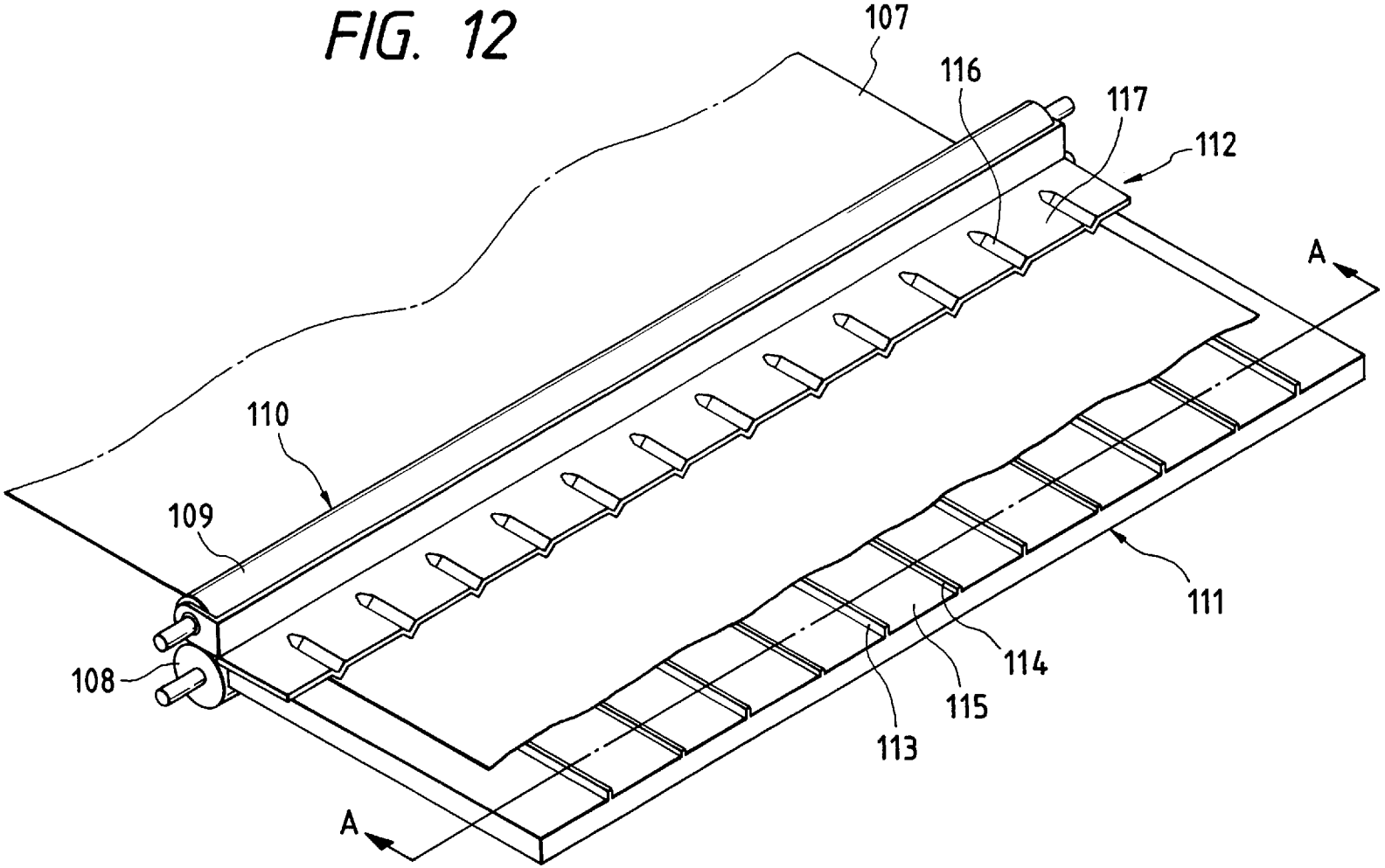
FIG. 12 is a perspective view which shows a state where a recording medium passes between a platen and a sheet pressure board.
Figure 14:
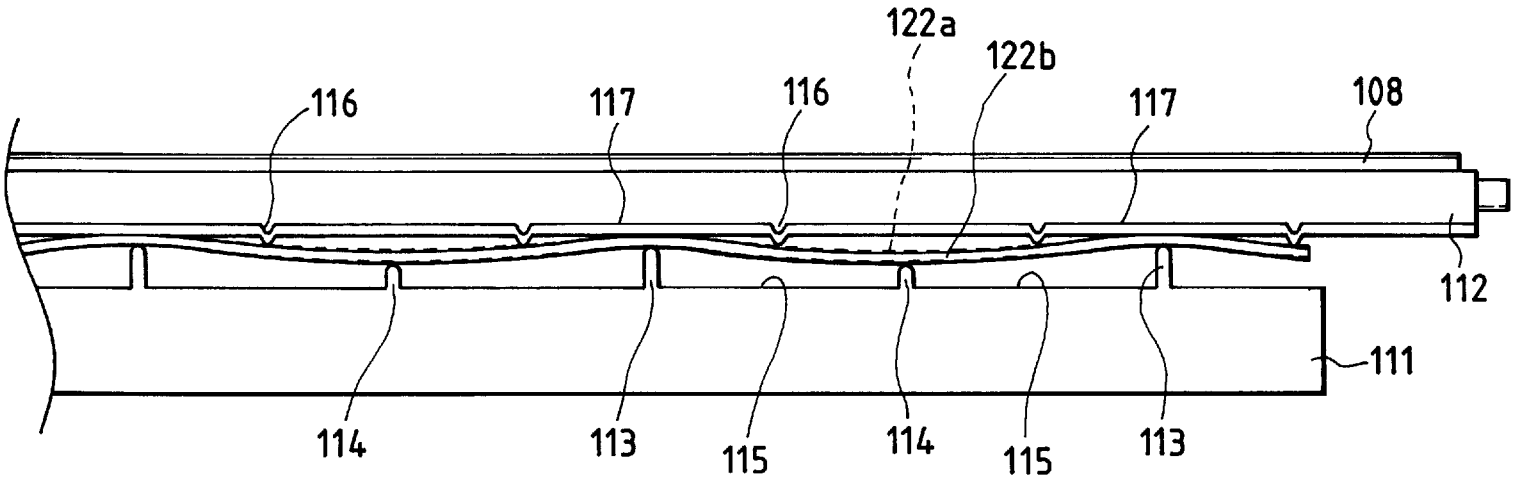
FIG. 14 is a cross-sectional view taken along line A—A in FIG. 12, which shows the behavior of a horizontally watermarked paper before and after recording.

Now, in conjunction with FIG. 12, FIG. 13, and FIG. 14, the description will be made separately of the behaviors of a recording apparatus before and after recording on a vertically watermarked paper and on a horizontally watermarked paper. In the recording operation described above, the recording medium 107 having passed the sheet pressure board 112 is provided with a waving configuration whose vertices are on its contacting plane with each rib 113 in each gap between ribs 113 on the platen 111, and troughs are on its contacting plane with each of the extrusions 116 of the sheet pressure board 112. Here, the left and right edges of the recording medium 107 tend to float easily toward the recording head 101 side due to the warping or the like. Therefore, the extrusions 116 of the sheet pressure board 112, and the extruded members on the downstream side in the sheet feeding direction are arranged in agreement with the edge portions of the recording medium. Thus, as shown in FIG. 13 and FIG. 14, the edge portions are pressed downwardly. If there are many kinds of sizes of the recording media to be used, the extrusions 116 of the sheet pressure board 112 and the extruded members on the downstream side should be arranged so that the left and right edges of each recording medium to be used are pressed downwardly. However, when it is attempted to arrange the left and right edges of all the sizes to be orientated downward by pressure, there appears a location where the left and right edges are concentrated. In such a case, if the pitches of the ribs 113 are too narrow, the waving curvature becomes intensified so as to contradict the nature of a recording medium 107 that it is fundamentally made to stay flat. As a result, in some of the gaps between ribs 113, no troughs are formed after all. It has been confirmed by experiments that in such a case, there may be created hills rising toward the head side instead.

Therefore, it is required to thin out the ribs 113 with respect to the extrusions 116 of the sheet pressure board 112 and the extruded members on the downstream side. Nevertheless, although described later, if it is intended to absorb the extension by the gaps between ribs 113, each individual cockling becomes greater when using a recording medium (vertically watermarked paper) that tends to expand in the direction rectangular to the sheet feeding direction, thus making the distance to the recording head 1 longer. To cope with this situation, therefore, the auxiliary ribs 144 are additionally arranged to minimize the cockling in a recording medium of the kind.

In FIG. 13, the vertically watermarked paper having passed the sheet pressure board 112 presents such a waving configuration as the vertically watermarked paper 121*a* indicated by broken line. At this juncture, if the images are recorded in high density, the vertically watermarked paper 121*a* is in a state where a great amount of recording ink is impacted using water as its main solvent. The size of the vertically watermarked paper 121*a* becomes larger due to swelling. Here, when the vertically watermarked paper absorbs water, it tends to swell by its nature in the direction rectangular to the sheet feeding direction. Now that the vertically watermarked paper 121*a* is fixedly positioned by contact at the plural contacting portions between the ribs 113 and the sheet pressure board 112 (namely, the vertices of the vertically watermarked paper 121*a* that has waved), it can hardly move even by the resultant swelling. On the contrary, as the movement is not regulated in the gaps between ribs 113, the expansion of the vertically watermarked paper 121*a* made by swelling takes place mainly between the ribs 113. Further, if the expansion resulting from swelling is greater, the vertically watermarked paper 121*a* abuts even upon the auxiliary ribs 114, hence creating cockling in the gaps between the plural ribs 113 and auxiliary ribs 114 (namely, in the recessed portions of the platen 115). In addition, it is arranged in advance to displace the cockling downwardly by means of the extrusions 116. As a result, it is orientated downward without exception to enable the vertically watermarked paper to be in a state as at 212*b* after recording as shown in FIG. 13. In this way, the swelling of the paper is distributed among the gaps of plural ribs 113, and further, it becomes uniform cockling by means of the auxiliary ribs 114 in the plural recessed portions 115 on the platen. Therefore, it is possible to minimize each individual cockling, and there is no possibility that the medium floats toward the recording head 101 side.

Now, in conjunction with FIG. 14, the description will be made of the behavior of a horizontally watermarked paper before and after recording. The horizontally watermarked paper having passed the sheet pressure board 112 presents such a waving configuration of the horizontally watermarked paper 122*a* indicated by broken line. At this juncture, if images are recorded in high density, the horizontally watermarked paper also swells to make its size larger. Here, the horizontally watermarked paper tends to swell easily by its nature in the same direction as the sheet feeding direction when it absorbs water. Therefore, the cockling is supposed to occur on the horizontally watermarked paper 122*a* in the same directions as the sheet feeding direction, but being provided in advance with the waving configuration (as the horizontally watermarked paper 122*a* in FIG. 14) in the gaps between ribs 113 extending in the same direction as the sheet feeding direction, the cockling is not allowed to occur in the same direction as the sheet feeding direction. As a result, after recording, only the portion slightly extending in the direction rectangular to the sheet feeding direction is absorbed, but the condition presents itself as indicated by the horizontally watermarked paper 122*b* after recording as illustrated in FIG. 14. Therefore, it is possible to minimize the cockling, and there is no possibility that the recording medium floats to the recording head side.

There is also a phenomenon called curling, which appears both on the vertically and horizontally watermarked papers. This is a phenomenon that paper is warped due to changes in the atmospheric environment, particularly due to an abruptly changed humidity. In the present embodiment, however, a recording medium is provided with a waving configuration on the upstream side of the recording area. Consequently, firmness is given to the recording medium to correct the curling of the recording medium, and there is also no possibility that it floats toward the recording head 101 side.

(Seventh Embodiment)

Figure 15:
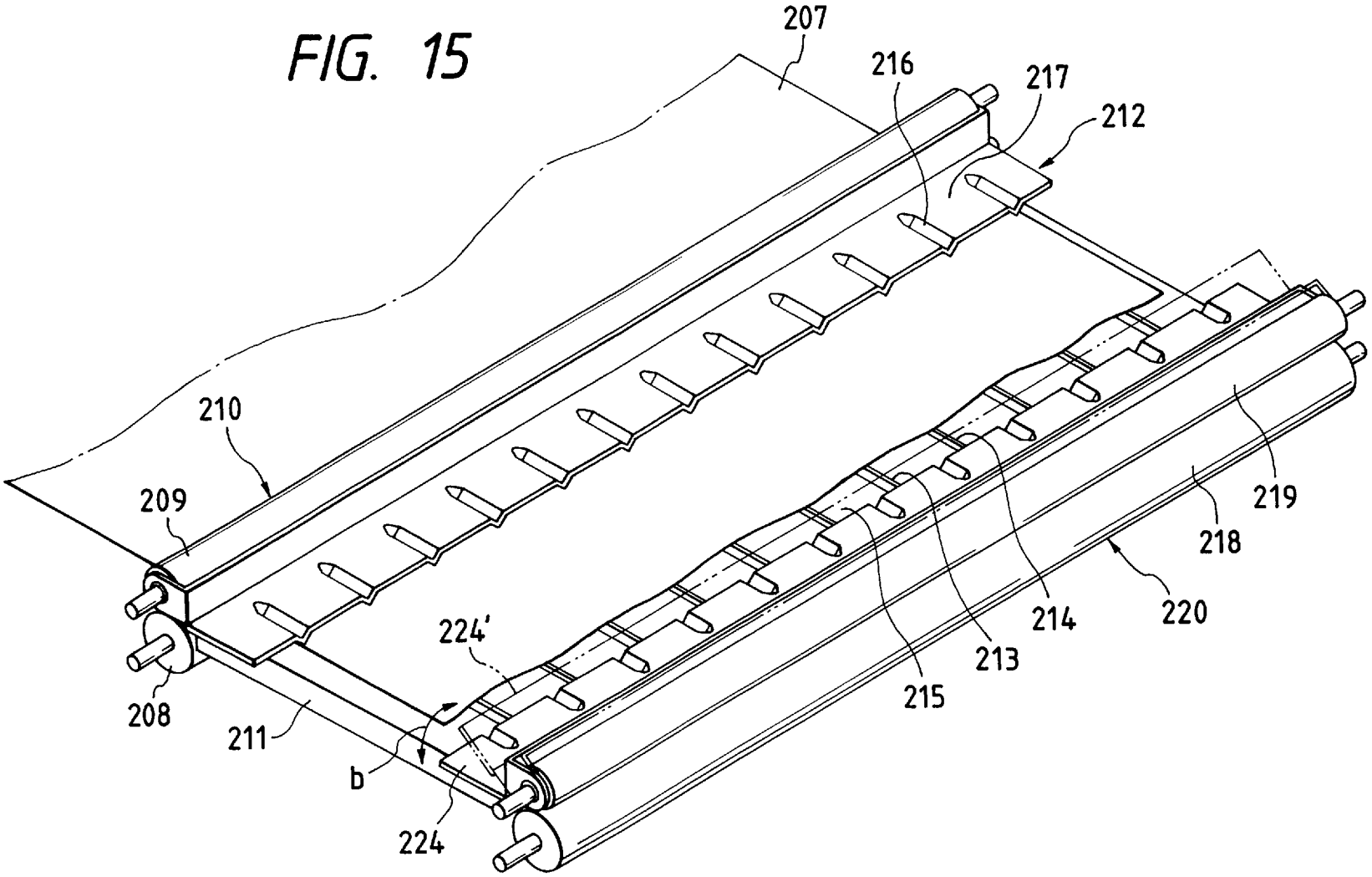
FIG. 15 is a perspective view which shows a state where a recording medium passes between the platen and sheet pressure board of a recording apparatus in accordance with a seventh embodiment of the present invention.

FIG. 15 is a perspective view which shows the state that a recording medium is being passed through the platen and sheet pressure board of a recording apparatus in accordance with a seventh embodiment of the present invention. In the sixth embodiment, an example is described, in which the sheet pressure board 112 is arranged on the upstream side of the recording area, but in the seventh embodiment, a sheet pressure board 224 is also arranged on the downstream side of the recording area as perspectively shown in FIG. 15. The sheet pressure board 224 is rotative in the direction indicated by arrow b around the sheet exhausting roller 219 by rotary means (not shown). When the recording medium 207 is carried, this board is in a state 224' as indicated by two-dot chain line, and is retracted so as to avoid hindering the carriage of the recording medium. In any other time, it is in a state 224 indicated by solid line to give a waving configuration to the recording medium 207. As a result, it is possible to provide the waving configuration both on the upstream and downstream sides of the recording area, thus obtaining the anticipated effects more reliably. Also, even after the trailing end of the recording medium 207 has passed the sheet pressure board 212 arranged on the upstream side of the recording area, it is possible to continuously give the waving configuration to the recording medium.

(Eighth Embodiment)

Figure 16:
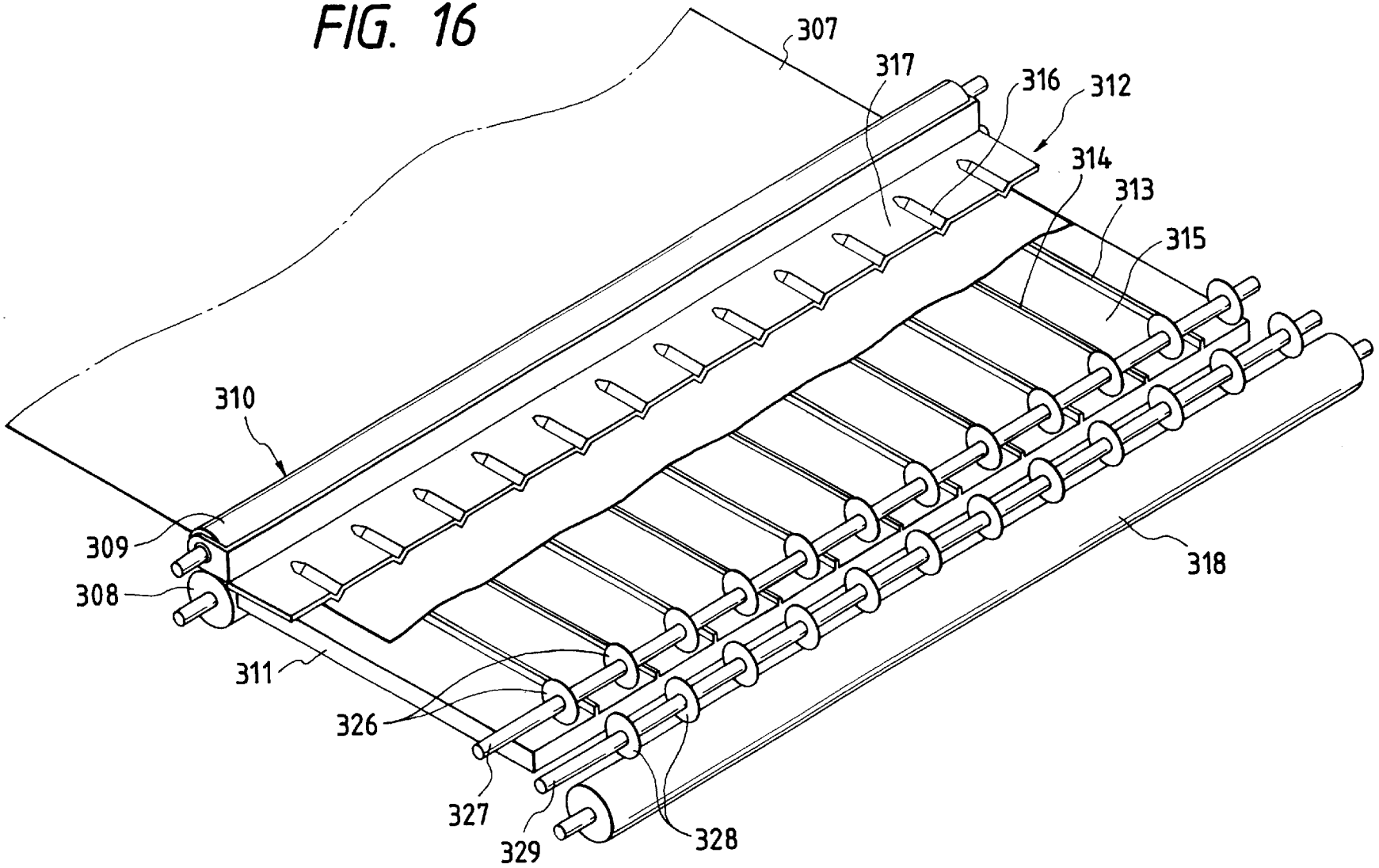
FIG. 16 is a perspective view which shows a state where a recording medium passes between the platen and sheet pressure board of a recording apparatus in accordance with an eighth embodiment of the present invention.

FIG. 16 is a perspective view which shows the state that a recording medium is being passed through the platen and sheet pressure board of a recording apparatus in accordance with an eighth embodiment of the present invention. Here, regarding the elements common to the sixth and seventh embodiments, the description will be omitted.

In the eighth embodiment, spurs 326 are arranged in the respective positions facing the extrusions 316 of the sheet pressure board 312 on the downstream side of the recording area so that the spurs enter the gaps between ribs 313 in the same amount thereof as shown in FIG. 16. A spur shaft 327 is provided to support the spurs 326. The spur shaft 327 is driven by a motor (not shown) to rotate. It is arranged to make the circumferential speed of the spurs 326 equal to the feeding speed of a recording medium in order to avoid any resistance that may be exerted when the spurs 326 run into the recording medium 307. On the downstream side of the spurs 326, there are arranged sheet exhaust spurs 328 supported by a sheet exhaust spur shaft 329 to enable the recording medium 307 to be exhausted from the recording unit. The sheet exhaust spurs 328 are biased to a driving roller 318 on the sheet exhausting side by biasing means (not shown), and rotate following the rotation of the driving roller.

With the structure described above, the spurs 326 play the same role as that of the extrusion 316 of the sheet pressure board 312. Therefore, it is possible to provide the waving configuration both on the upstream and downstream sides of the recording area, and prevent the recording medium 307 from floating toward the recording head side reliably. Also, it is possible to provide the waving configuration continuously by means of spurs 326 even after the trailing end of the recording medium 307 has passed the sheet pressure board 312.

Figure 17:
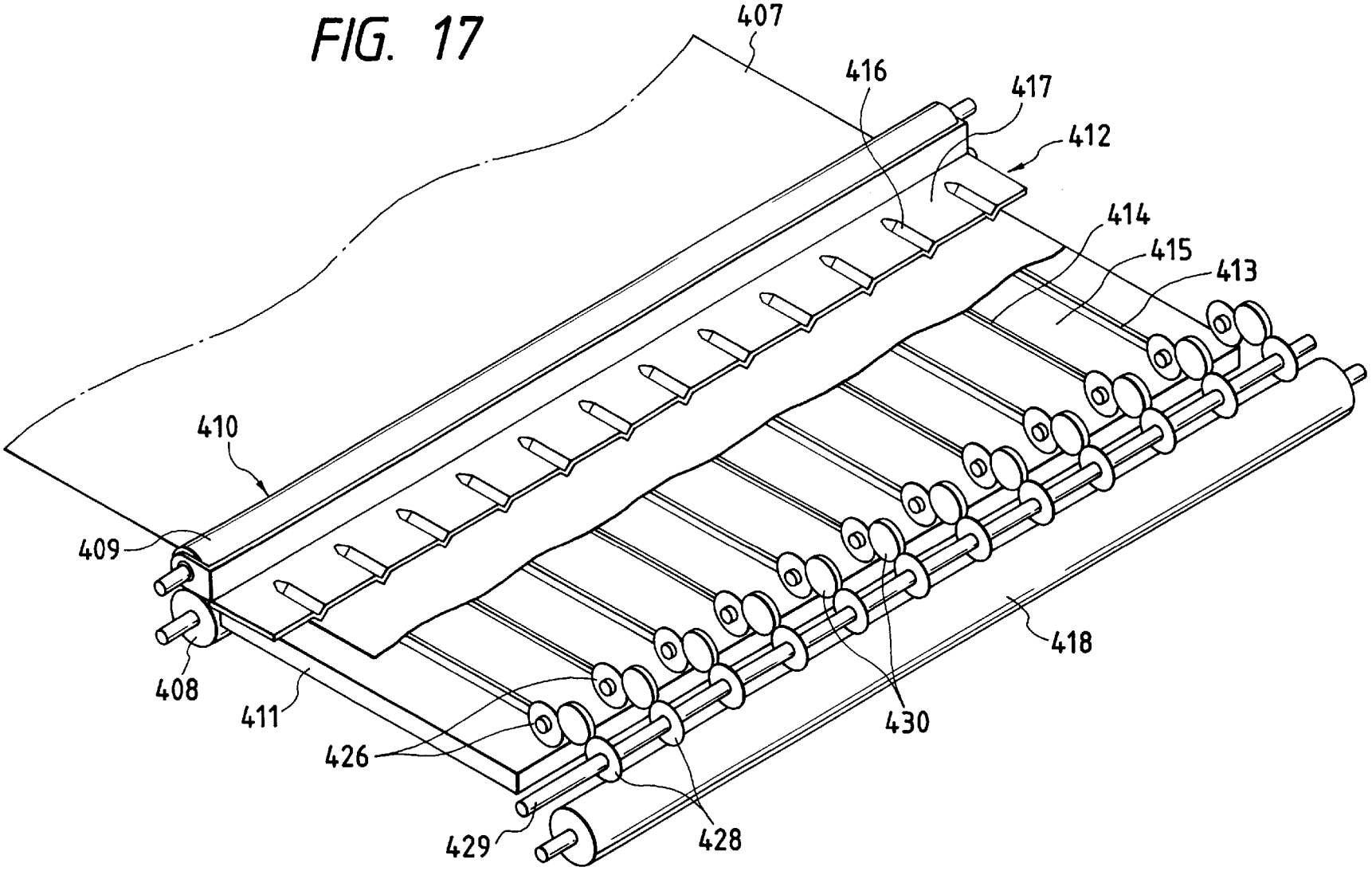
FIG. 17 is a perspective view which shows a state where a recording medium passes between the platen and sheet pressure board of a recording apparatus in accordance with a modification of the eighth embodiment of the present invention.

FIG. 17 is a perspective view which shows the state that a recording medium is being passed through the platen and sheet pressure board of a recording apparatus of the eighth embodiment having cleaners provided therefor. It may be possible to arrange cleaners 430 for removing recording ink adhering to the spurs 326 and sheet exhaust spurs 328 of the eighth embodiment. As shown in FIG. 17, the cleaners 430 are evenly pressed to both the spurs 426 and sheet exhaust spurs 428.

In the structure described above, the cleaners 430 rotate following the rotation of the sheet exhaust spurs 428, and further, cause the spurs 426 to rotate following the rotation of the cleaner. Therefore, it is possible to rotate the spurs 426 in the circumferential speed substantially equal to that of the driving roller 418 on the sheet exhausting side.

Here, in the present embodiment, the description has been made of the provision of spurs, but the present invention is not limited to the use of spurs if only a structure is arranged to satisfy the described performance. Also, the amount of ingression of the spurs has been described as being the same as that of the extrusions of the sheet pressure board, but it may be possible to adopt a different amount of such ingression.

(Ninth Embodiment)

Figure 18:
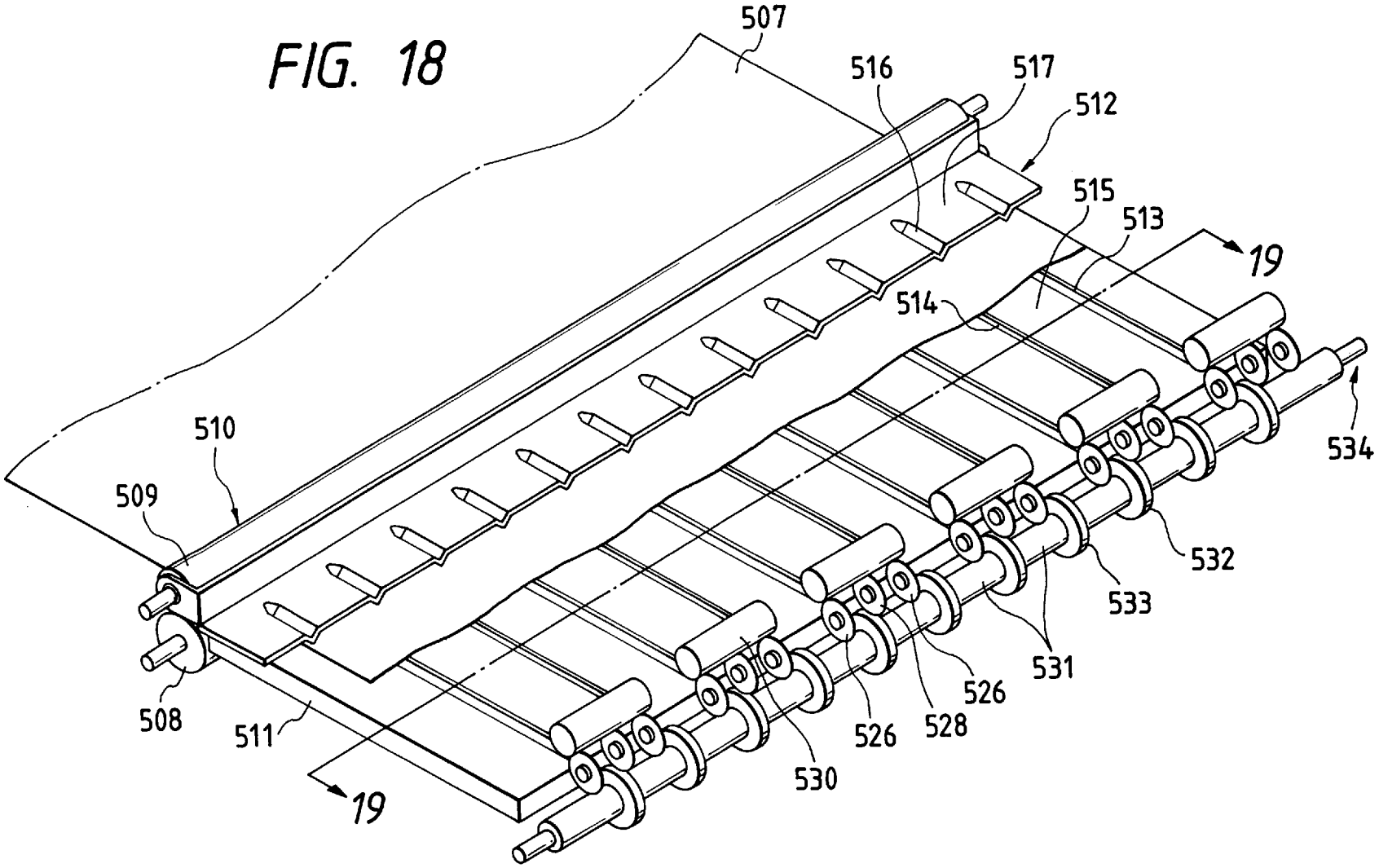
FIG. 18 is a perspective view which shows a state where a recording medium passes between the platen and sheet pressure board of a recording apparatus in accordance with a ninth embodiment of the present invention.
Figure 19:
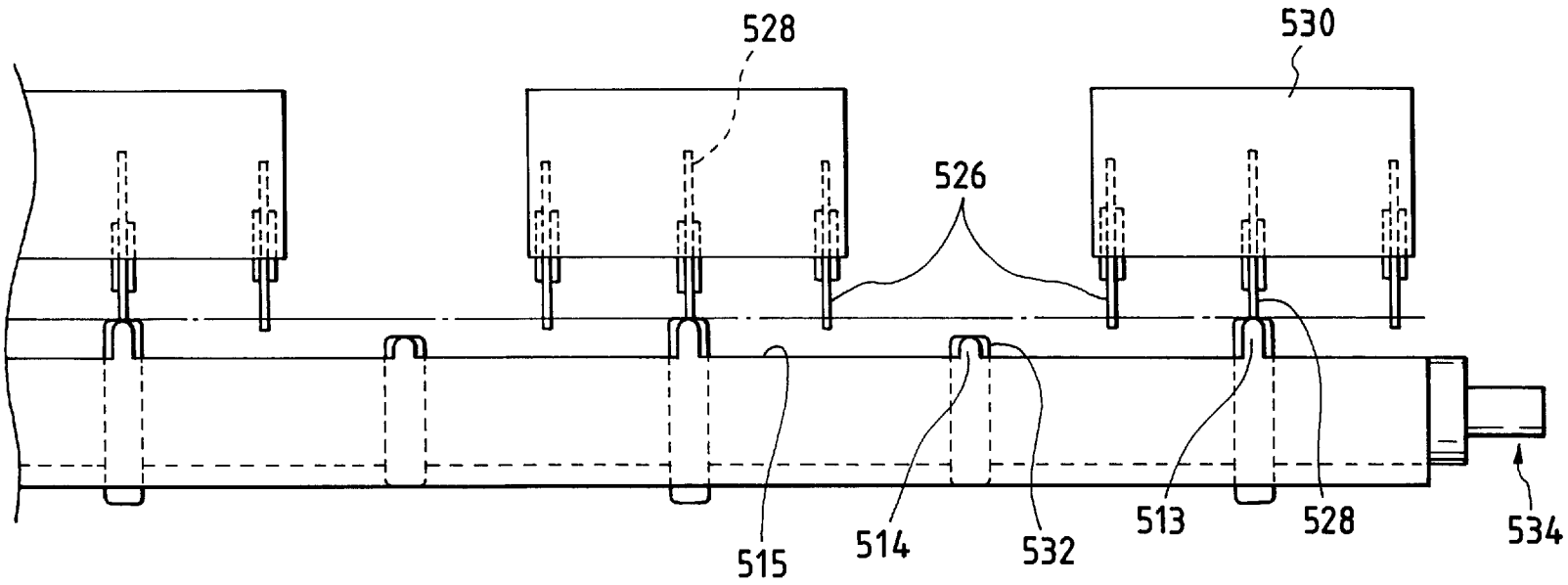
FIG. 19 is a cross-sectional view taken along line 19—19 in FIG. 18.

FIG. 18 is a perspective view which shows the state that a recording medium is being passed through between the platen and sheet pressure board of a recording apparatus in accordance with a ninth embodiment of the present invention. FIG. 19 is a cross-sectional view taken along line 19—19 in FIG. 18. The ninth embodiment is such that the spurs 326 of the eighth embodiment are arranged on the driving roller on the sheet exhausting side. Regarding the elements common to the sixth to eighth embodiments, any repeated description will be omitted.

In FIG. 18 and FIG. 19, there is arranged as a driving roller on the sheet exhausting side, a strip type sheet exhausting roller 534 having recesses 531, and first extrusions 532 and second extrusions 533 on it. The strip type sheet exhaust roller 534 is driven by a motor (not shown) to rotate. The recesses 531 are formed on the extended lines of the recessed portions of the platen 515, while the first extrusions 532 are formed on the extended lines of the ribs 513 and the second extrusions 533 are formed on the extended lines of the auxiliary ribs 514, respectively. These extrusions are arranged to be the same height as that of the ribs 513 and auxiliary ribs 514. The spurs 526 are arranged in the same positions and same amount of ingression as the extrusions 516 of the sheet pressure board 512 on the recesses 531, and rotatively supported by holders (not shown) in fixed positions. The sheet exhaust spurs 528 are rotatively supported by holders (not shown), and pressed to the first extrusions 532 to rotate following the rotation of the sheet exhausting roller. Cleaners 530 are the members to remove recording ink adhering to the spurs 526 and sheet exhaust spurs 528. In the present embodiment, each cleaner rotates following the rotation of each one of the sheet exhaust spurs 528 and cause each two of the spurs 526 to rotate following the rotation of the respective cleaner.

In the structure described above, the recesses 531 of the strip type sheet exhausting roller 534 and the spurs 526 play the same roles as those of the recesses 515 and extrusions 516 of the platen. The first extrusions 532 and second extrusions 533 play the same roles as those of the ribs 513 and auxiliary ribs 514. Therefore, it is possible to provide the waving configuration for the recording medium 507 assuredly until it has been exhausted, and prevent the recording medium 507 from floating more reliably.

Also, since the spurs 526 and sheet exhaust spurs 528 are arranged on the same lines, the sheet exhaust roller can be positioned farther on the upstream side in the sheet feeding direction to make it possible to pinch a recording medium earlier. Hence its transfer to the downstream side becomes more reliable.

In the sixth to ninth embodiments described above, if the distance is short between the resist roller pairs 110, 210, 310, 410, or 510, and the extrusions 116, 216, 316, 416, or 516 of the sheet pressure boards 112, 212, 312, 412, or 512, the waving of the recording medium 107, 207, 307, 407, or 507 may be hindered by the nipping (pinching) of the resist roller pairs 110, 210, 310, 410, or 510 in some cases, it may be possible to provide the troughs of the waving configuration in the portions corresponding to the recesses 115, 215, 315, 415, or 515 of the platen of the driving roller on the sheet exhausting side 108, 208, 308, 408, or 508.

(Tenth Embodiment)

Figure 20:
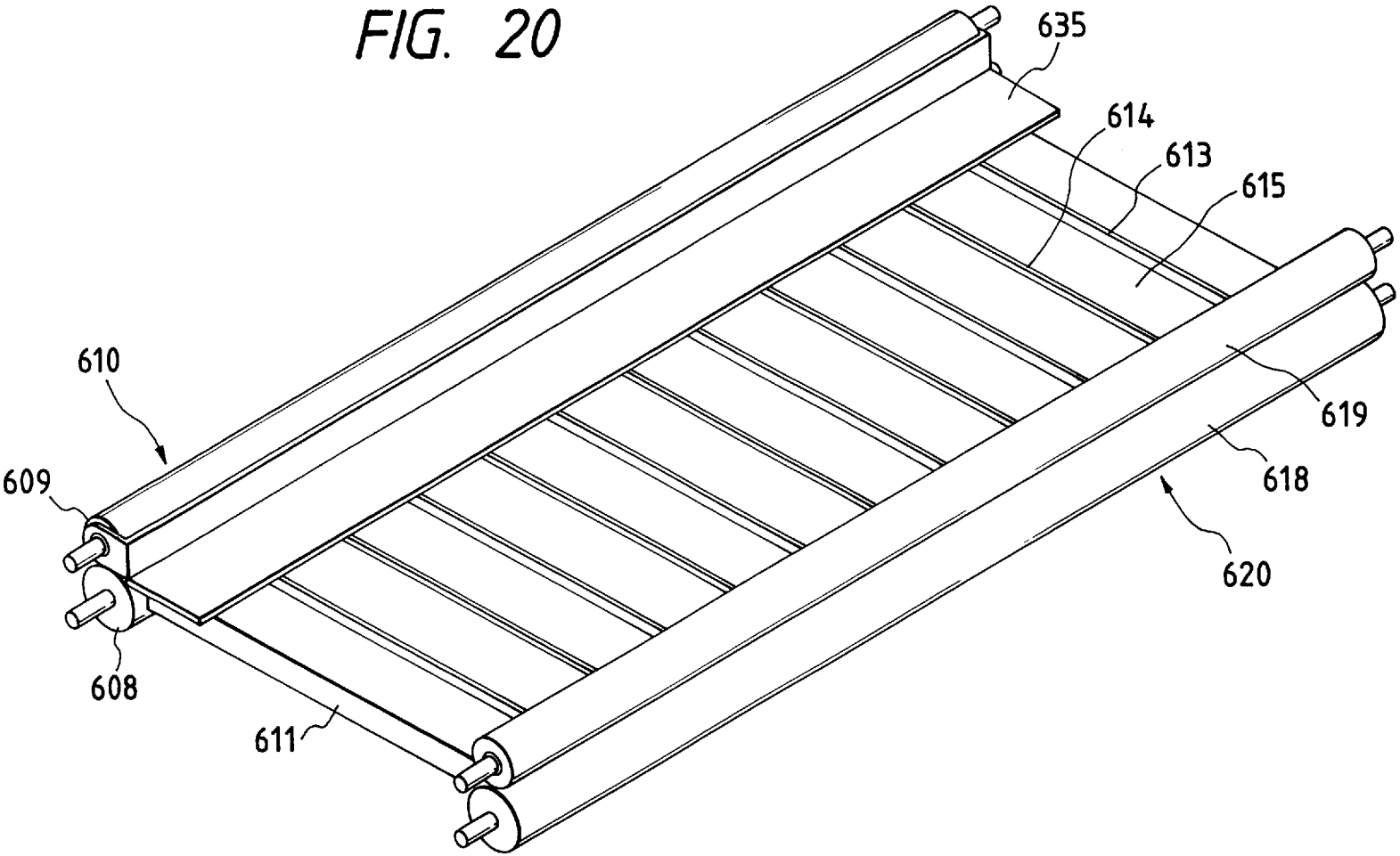
FIG. 20 is a partial view which shows perspectively the vicinity of the platen and sheet pressure board of a recording apparatus in accordance with a tenth embodiment of the present invention.

FIG. 20 is a partial view which perspectively shows the vicinity of the platen and sheet pressure board of a recording apparatus in accordance with a tenth embodiment of the present invention. Regarding the elements common to the sixth to ninth embodiments, any repeated description will be omitted.

The present embodiment is of such a structure that a flat sheet pressure board 635 is biased to the platen 611 side by biasing means (not shown) to enable it to abut upon the ribs 613 of the platen 611. This embodiment relates to an apparatus whose use is limited to recording on the vertically watermarked paper.

Here, as described earlier, the vertically watermarked paper tends to swell in the direction rectangular to the sheet feeding direction by its nature when it absorbs water. Therefore, just by fixing the position of the vertically watermarked paper on a plurality of contacting portions between the ribs 613 and the flat sheet pressure board 635, it is possible to create cockling on the recessed portions 615 of the platen. Also, the upper surface of the recording medium being regulated by the flat sheet pressure board 635, the cockling is orientated downward reliably, and there is no possibility that the recording medium floats toward the recording head side.

(Eleventh Embodiment)

Figure 21:
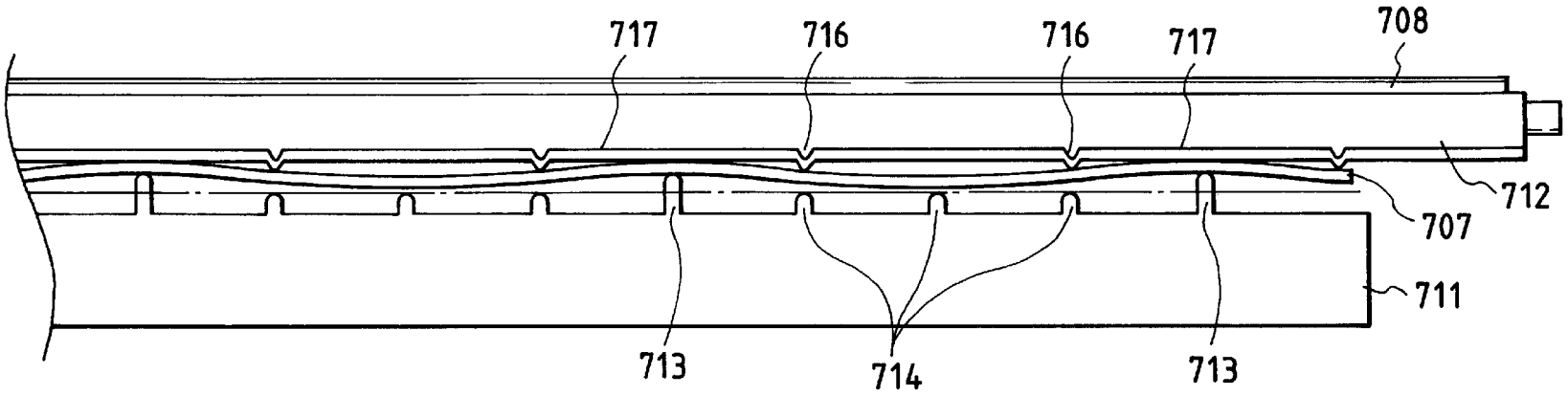
FIG. 21 is a cross-sectional view which shows the vicinity of the platen and sheet pressure board in accordance with an eleventh embodiment of the present invention.

FIG. 21 is a cross-sectional view which shows the vicinity of the platen and sheet pressure board of an eleventh embodiment in accordance with the present invention.

In the sixth to tenth embodiments described above, it has been exemplified that ribs 113, 213, 313, 413, 513, or 613 and the auxiliary ribs 114, 214, 314, 414, 514, or 614 are arranged alternately, but as one embodiment represented in FIG. 21, it may be possible to arrange a plurality of auxiliary ribs 714 between ribs 713.

(Twelfth Embodiment)

Figure 22:
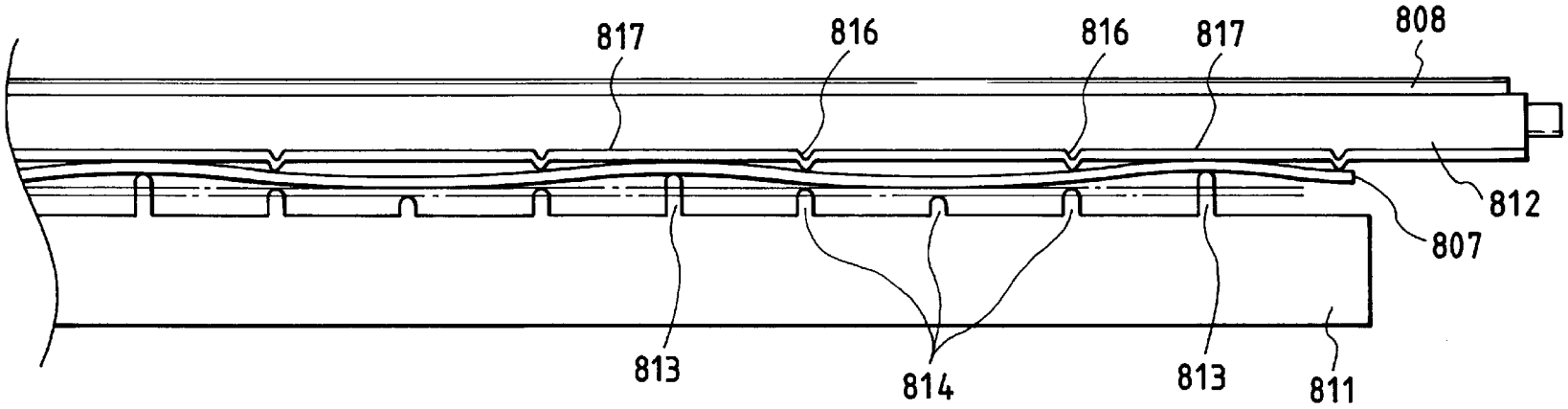
FIG. 22 is a cross-sectional view which shows the vicinity of the platen and sheet pressure board in accordance with a twelfth embodiment of the present invention.

FIG. 22 is a cross-sectional view which shows the vicinity of the platen and sheet pressure board of a twelfth embodiment in accordance with the present invention.

As shown in FIG. 22, it may be possible to prepare plural kinds of heights for a plurality of auxiliary ribs 814 between ribs 813. In the structure described above, since a plurality of auxiliary ribs 814 are arranged between ribs 813, it is possible to suppress the cockling of the vertically water-marked paper lower.

As has been described, in accordance with each of the embodiments, it is possible to minimize each individual cockling that may take place due to the permeation of ink into a recording medium in an ink jet recording apparatus for recording by discharging ink, and also, to orientate the cockling downward, thus obtaining a significant effect to prevent the recording medium and recording head from being in contact with each other.

Further, as a result of such preventive effect, the distance is made shorter between the surface of a recording medium and a recording head, hence making it possible to enhance the impacting accuracy of discharged grains of recording ink. Also, it is possible to prevent a recording medium from floating due to the curling of the recording medium itself by providing the recording medium with a waving configuration to give firmness to it.

In other words, the present invention makes it possible to prevent the quality of recorded images from being degraded due to curling or cockling of the recording medium to be used, and effectuates an excellent recording by means of ink jet discharge.

What is claimed is:

1. An ink jet recording apparatus using ink jet recording means for recording by discharging ink onto a recording medium arranged in a recording area, said apparatus comprising:

means for feeding the recording medium in a feeding direction, said feeding means being arranged for the recording area and provided with a mechanism to provide irregular configuration of the recording medium in a direction intersecting the feeding direction of the recording medium, wherein said feeding means comprises a platen positioned to face the ink jet recording means, and being provided with a plurality of recesses and a plurality of irregularities on a plane facing the ink jet recording means in a same direction as the feeding direction, and pressure members positioned to face the plurality of recesses of said platen to press the recording medium to said platen.

2. An ink jet recording apparatus using ink jet recording means for recording by discharging ink onto a recording medium arranged in a recording area, said apparatus comprising:

means for feeding the recording medium in a feeding direction, said feeding means being arranged for the recording area and provided with a mechanism to provide irregular configuration of the recording medium in a direction intersecting the feeding direction of the recording medium, wherein said feeding means comprises a platen positioned to face the ink jet recording means, and being provided with a plurality of recesses and a plurality of irregularities on a plane facing the ink jet recording means in a same direction as the feeding direction, and a pressure board for contacting with the irregularities of said platen, and provided with pressure members positioned to face the plurality of recesses of said platen to press the recording medium to said platen.

3. An ink jet recording apparatus using ink jet recording means for recording by discharging ink onto a recording medium arranged in a recording area, said apparatus comprising:

means for feeding the recording medium in a feeding direction, said feeding means being arranged for the recording area and provided with a mechanism to provide irregular configuration of the recording medium in a direction intersecting the feeding direction of the recording medium, wherein said feeding means comprises a platen positioned to face the ink jet recording means, and being provided with a plurality of recesses and a plurality of irregularities on a plane facing the ink jet recording means in a same direction as the feeding direction, a sheet pressure board for contacting with the irregularities of said platen on an upstream side of the recording area of the ink jet recording means, and being provided with first pressure members positioned to face the plurality of recesses of said platen to press the recording medium to said platen, and second pressure members positioned to face the plurality of recesses of said platen on a downstream side of the recording area of the ink jet recording means to press the recording medium to the platen.

4. An ink jet recording apparatus according to claim 1, wherein said second pressure members arranged to face the plurality of recesses of said platen on the downstream side of the recording area of the ink jet recording means comprise rotational spurs.

5. An ink jet recording apparatus using ink jet recording means for recording by discharging ink onto a recording medium arranged in a recording area, said apparatus comprising:

means for feeding the recording medium in a feeding direction, said feeding means being arranged for the recording area and provided with a mechanism to provide irregular configuration of the recording medium in a direction intersecting the feeding direction of the recording medium, wherein said feeding means comprises a platen positioned to face the ink jet recording means, and being provided with a plurality of recesses and a plurality of irregularities on a plane facing the ink jet recording means in a same direction as the feeding direction, a sheet pressure board for contacting with the irregularities of said platen on an upstream side of the recording area of the ink jet recording means, and being provided with pressure members positioned to face the plurality of recesses of said platen to press the recording medium to said platen, a roller arranged in the vicinity of a downstream end of said platen and facing the plurality of irregularities of said platen, said roller being provided with a plurality of extruded sections aligned with said irregularities of said platen and a plurality of recessed sections, first spurs rotatively extending into the recessed sections of said roller, and second spurs abutting upon the extruded sections of said roller.

6. An ink jet recording apparatus according to claim 2, wherein said plurality of irregularities on the plane facing the ink jet recording means are of two or more heights, and said pressure board contacts the highest irregularity of said platen.

7. An ink jet recording apparatus according to claim 1, wherein said plurality of irregularities on the plane facing the ink jet recording means are of two or more heights.

8. An ink jet recording apparatus according to claim 2, wherein said plurality of irregularities on the platen facing the ink jet recording means are of two or more heights, and said pressure board contacts the highest irregularity of said platen, said pressure board being provided with pressure members positioned to face a plurality of recesses on said platen to press the recording medium to said platen.

9. An ink jet recording apparatus according to claim 3, wherein said plurality of irregularities on the plane facing the ink jet recording means are of two or more heights and said sheet pressure board contacts the highest irregularity of said platen on the upstream side of the recording area of said ink jet recording means.

10. An ink jet recording apparatus according to claim 9, wherein said second pressure members arranged to face the plurality of recesses of said platen on the downstream side of the recording area of the ink jet recording means comprise rotational spurs.

11. An ink jet recording apparatus according to claim 1, wherein said plurality of irregularities on the plane facing the ink jet recording means are of two or more heights and said sheet pressure board contacts the highest irregularity of said platen on the upstream side of the recording area of the ink jet recording means.

12. An ink jet recording apparatus for recording on a recording medium located at a recording area using ink jet recording means for discharging ink to record, said apparatus comprising:

a platen having a plurality of projections provided at a position opposable to the ink jet recording means, said projections protruding from a face opposed to the ink jet recording means along a conveying direction of the recording medium;

a first rotary member provided downstream of the ink jet recording means in the conveying direction of the recording medium to contact said projections, said first rotary member contacting said projections through the recording medium; and a second rotary member provided downstream of the ink jet recording means in the conveying direction of the recording medium, said second rotary member projecting into an area between said projections.

13. An ink jet recording apparatus according to claim 2, wherein said pressure board contacts the irregularities of said platen through the recording medium.

14. An ink jet recording apparatus according to claim 3, wherein said sheet pressure board contacts the irregularities of said platen through the recording medium.

15. An ink jet recording apparatus according to claim 5, wherein said sheet pressure board contacts the irregularities of said platen through the recording medium.

* * * * *

UNITED STATES PATENT AND TRADEMARK OFFICE

CERTIFICATE OF CORRECTION

PATENT NO. : 5,874,979

DATED : February 23, 1999

INVENTOR(S) : OHYAMA

It is certified that error appears in the above-identified patent and that said Letters Patent is hereby corrected as shown below:

On the title page: Item

[56] References Cited:

FOREIGN PATENT DOCUMENTS, "3029352" should read --3-29352--.

"4069264" should read --4-69264--.

COLUMN 4:

Line 29, "form" should read --from--.

COLUMN 16:

Line 20, "claim 1," should read --claim 3,--.

Signed and Sealed this

Fourteenth Day of September, 1999

*Attest:*

Q. TODD DICKINSON

*Attesting Officer*

*Acting Commissioner of Patents and Trademarks*